US007909423B2

(12) United States Patent
Saikawa et al.

(10) Patent No.: US 7,909,423 B2
(45) Date of Patent: Mar. 22, 2011

(54) INK JET RECORDING HEAD

(75) Inventors: Akihisa Saikawa, Tokyo (JP); Yoshiyuki Toge, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 12/141,517

(22) Filed: Jun. 18, 2008

(65) Prior Publication Data

US 2009/0033719 A1 Feb. 5, 2009

(30) Foreign Application Priority Data

Jun. 19, 2007 (JP) ..... 2007-161592

(51) Int. Cl.
*B41J 29/38* (2006.01)

(52) U.S. Cl. ..... 347/17; 347/48; 347/60

(58) Field of Classification Search ..... 347/17, 347/18, 20, 56–59, 48, 60
See application file for complete search history.

(56) References Cited

U.S. PATENT DOCUMENTS

| | | | | |
|---|---|---|---|---|
| 4,965,594 | A * | 10/1990 | Komuro | 347/62 |
| 5,467,113 | A * | 11/1995 | Ishinaga et al. | 347/17 |
| 5,861,895 | A | 1/1999 | Tajika et al. | |
| 6,315,396 | B1 | 11/2001 | Ozaki et al. | |

FOREIGN PATENT DOCUMENTS

| | | |
|---|---|---|
| JP | 3-005151 | 1/1991 |
| JP | 5-031905 | 2/1993 |
| JP | 10-000774 | 1/1998 |
| JP | 10-000776 | 1/1998 |

* cited by examiner

*Primary Examiner* — Juanita D Stephens
(74) *Attorney, Agent, or Firm* — Fitzpatrick, Cella, Harper & Scinto

(57) ABSTRACT

An ink jet recording head includes an ejection outlet array including a plurality of ejection outlets; an ink flow path portion in fluid communication with the ejection outlets to supply ink to the ejection outlets; a recording element substrate provided with the ejection outlet array, the ink flow path portion and a plurality of ejection heat generating resistors, provided correspondingly to the ejection outlets, for generating thermal energy for ejecting ink; a first warming heat generating resistor which is provided in lower layers of the ejecting heat generating resistors and which is extended below the ink flow path portion; and a second warming heat generating resistor provided in an outer peripheral portion of the recording element substrate.

13 Claims, 24 Drawing Sheets

HEAD TEMP.VS.FIRST SHOP PROPERTY

| TEMP. | 15°C | 25°C | 30°C | 40°C | 50°C |
|---|---|---|---|---|---|
| INTERRUPTABLE NO.OF SCANS | 0.5scan | 1.5scans | 2scans | 6scans | 7scans |

FIG.8

HEAD TEMP.VS.FIRST SHOT PROPERTY

| | 15°C | 25°C | 30°C | 40°C | 50°C |
|---|---|---|---|---|---|
| 1ST OUTLET | 0.5scan | 1.5scans | 2scans | 6scans | 7scans |
| 2ND OUTLET | 0.5scan | 0.5scan | 1scan | 3scans | 6scans |

FIG.17

| HT TMP.T°C BY SNSR | GN-PERIOD | TEMP. RISE BY 1ST HTR | TEMP. RISE BY 2ND HTR |
|---|---|---|---|
| 0 ≦T<5 | $T_F$ | 40°C | 60°C |
| 5 ≦T<10 | $T_E$ | 40°C | 53°C |
| 10 ≦T<20 | $T_D$ | 30°C | 45°C |
| 20 ≦T<30 | $T_C$ | 20°C | 30°C |
| 30 ≦T<40 | $T_B$ | 13°C | 20°C |
| 40 ≦T<50 | $T_A$ | 7°C | 10°C |
| T≧50 | 0 | 0°C | 0°C |

FIG.19

INK JET RECORDING HEAD

FIELD OF THE INVENTION AND RELATED ART

The present invention relates to an ink jet recording head in which a travelling droplet is produced by an ejection of an ink in order to effect the recording. More particularly, it relates to the ink jet recording head in which an ejecting resistor for ejecting the ink heated by the warming resistor is driven.

In an ink jet recording apparatus of a thermal type, a pulse voltage is applied to a heat generating resistor, by which the ink adjacent to the heat generating resistor in an ink chamber is boiled instantaneously, and an expansion of a bubble produced ejects the ink from an ink ejection outlet. Therefore, required drive energy in order to eject a predetermined amount of the ink changes with an ink temperature and the temperature of a recording head. On the contrary, when the constant driving energy is always supplied to the heat generating resistor, an ejection amount of the ink varies due to a change of an ambient temperature, or a temperature rise of the recording head by a continuous usage, and therefore, a density and a color tone of an image recorded vary, and a quality of the image deteriorates.

In order to avoid such a deterioration of the quality of the image, a temperature detecting element is provided in the inside of a semiconductor element (recording element substrate) of the recording head, a recording head temperature is sensed, and a pulse width of a driving pulse is adjusted in response to the detected temperature. The above described adjusting means has schematically following structures. For example the temperature detecting element provided in the recording head is a diode, and it supplies a forward-direction voltage VF when a constant current flows through the diode to the A/D converter, where the voltage is converted to a digital quantity to sense a change amount due to the temperature of forward-direction voltage VF. An ambient condition temperature range of the recording head is divided into some, and the table for a pulse width of a driving pulse signal which drives the heat generating resistor is provided for each temperature region, and the pulse width table is changed correspondingly to the temperature of the recording head and a variation of the ejection amount of the ink due to the temperature change is suppressed.

When the temperature of the recording head is low (0° C.-15° C.), a viscosity of the ink is high, and therefore, in order to assure a predetermined ejection amount of the ink, a double pulse drive is carried out by additionally applying the pre-pulse for the pre-heating (JP 5-31905A). The pre-heating for the ink is carried out by heating the recording element substrate by a sub-heater provided on the recording element substrate in another method, by which a deterioration of the ejection property at the time of a low temperature is avoided. In JP 3-5151A which discloses an example of this method, the sub-heater is provided in the same layer as the ejecting resistor. Furthermore, the sub-heater constituted as a lower layer of the ejecting resistor by the layer used by IC circuit is employed, by which bulkiness of the recording element substrate is prevented or an increase of the number of the manufacturing steps is prevented (JP 10-774A).

However, the following problems are involved in these conventional ink jet recording heads.

In order to improve a first shot property (a first ejection property after the ink non-ejection for a while) by the heating of the ink, a range adjacent to the ejection outlet is heated, in some cases. In this case, when the driving pulse waveform adjusted at the degree which is not enough for bubble generation of the ink is employed for the ejecting resistor, the deterioration of a recording speed and a cost increase result from a complicated pulse control, and since a time is required for the temperature rise of the ink jet recording head, the recording speed decreases. In the case of carrying out the temperature control in the recording operation, the recording speed decreases.

Furthermore, the heat radiation may occur from an end of the recording element substrate with the temperature rise of the recording element substrate due to a bubble generation of the ejecting resistor during the recording operation, by this, between the end and a central portion in the recording element substrate, a temperature difference may result. If this occurs, because of the influence of the ink viscosity depending on a temperature of the ink, the ejection properties, such as the ink ejection speed and the ejection amount of the ink, differ in the recording element substrate, and as a result, the color density and the color tone of the image which are recorded on a medium change, and there is a possibility of resulting in the deterioration of an image quality such as strips or non-uniformity.

In addition, in a recent ink jet recording head, in order to accomplish the property improvement and a cost reduction, A plurality of nozzles for two or more sorts of ink and/or, the different nozzles for an ejection of the ink droplets which have the size different from each other are efficiently provided on one recording element substrate. For the usage of such the different nozzles, it is necessary to solve the following problems.

In the case of using a high viscosity ink and a low viscous ink in the same recording element substrate, the high ink temperature is desirable in consideration of the ejection property of the ink of the high viscosity. However, if this is done, the temperature of a whole recording element substrate rises, so that the viscosity further lowers with respect to the low viscous ink, and therefore, it is not so preferable. In addition, the temperature of a whole recording head also rises, and an excessive temperature rise preventing circuit tends to operate frequently. This applies, also in the case where the first shot property is improved by the heating of the ink. It is preferable that sufficient first shot property is provided in all the ink kinds, but it may not necessarily be possible to accomplish the target values for the coloring, the deterioration, and so on of the various inks, and sufficient first shot property may not be provided depending on the ink kind.

In addition, there is the difference in the first shot property depending on the size of the ink droplet, i.e., the size of the ink ejection outlet, even with the same ink. Namely, the first shot property deteriorates with the reduction of the size of an ejection outlet, and therefore, the situation becomes severe with the tendency toward the smallness of droplets. If an attempt is made to improve the ejection property of the poor first shot property, and the ejection property of the relatively small ejection outlet array by the heating, the temperature of the whole recording element substrate rises, and therefore, for the other ink or the other ejection outlet array, it is not preferable. In addition, the temperature of the whole recording head also rises and the excessive temperature rise preventing circuit tends to operate frequently.

SUMMARY OF THE INVENTION

It is a principal object of the present invention, there is provided an ink jet recording head in which a stabilized ejection control is made easy by changing a heating degree depending on a position on recording element substrate, without raising a temperature of a head more than needed.

According to an aspect of the present invention, there is provided an ink jet recording head comprising an ejection outlet array including a plurality of ejection outlets; an ink flow path portion in fluid communication with said ejection outlets to supply ink to said ejection outlets; a recording element substrate provided with said ejection outlet array, said ink flow path portion and a plurality of ejection heat generating resistors, provided correspondingly to said ejection outlets, for generating thermal energy for ejecting ink; a first warming heat generating resistor which is provided in lower layers of said ejecting heat generating resistors and which is extended below said ink flow path portion; and a second warming heat generating resistor provided in an outer peripheral portion of said recording element substrate.

According to another aspect of the present invention, there is provided an ink jet recording head comprising a plurality of ejection outlet arrays each comprising a plurality of ejection outlets; an ink flow path portion in fluid communication with said ejection outlets to supply ink to said ejection outlets; a plurality of ink supply ports for supplying ink to said ink flow path portion for said ejection outlet arrays; a recording element substrate provided with said ejection outlet arrays, said ink flow path portion and a plurality of ejection heat generating resistors, provided correspondingly to said ejection outlets, for generating thermal energy for ejecting ink; first warming heat generating resistors which are provided in lower layers of said ejecting heat generating resistors and which are extended below said ink flow path portion for said ejection outlet arrays; and a plurality of warming heat generating resistors provided extended below said flow path portion.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3 is a perspective view of the printing head portion according to the first embodiment of the present invention.

FIG. 8 illustrates a relation between a head temperature and a first shot property in the first embodiment according to the present invention.

FIG. 17 illustrates a relation between the head temperature and the first shot property in the third embodiment according to the present invention.

FIG. 19 shows a relation between a heat generating time and an ink temperature in a warming resistor according to the first embodiment of the present invention.

DESCRIPTION OF THE PREFERRED EMBODIMENTS

The description will be made referring the accompanying drawings as to the embodiments of the present invention.

The values given in the following embodiments are examples, and the present invention is not limited to these values. In addition, the present invention is not limited to the embodiments.

First Embodiment

The description will be made about a basic structure of an ink jet print head cartridge according to an embodiment of the present invention.

In an ink jet recording head of the present embodiment, a printing head portion carries out a recording operation using an electrothermal transducer for generating a thermal energy for ejecting the ink by creating a film boiling in the ink in response to an electric signal.

Figure 1:
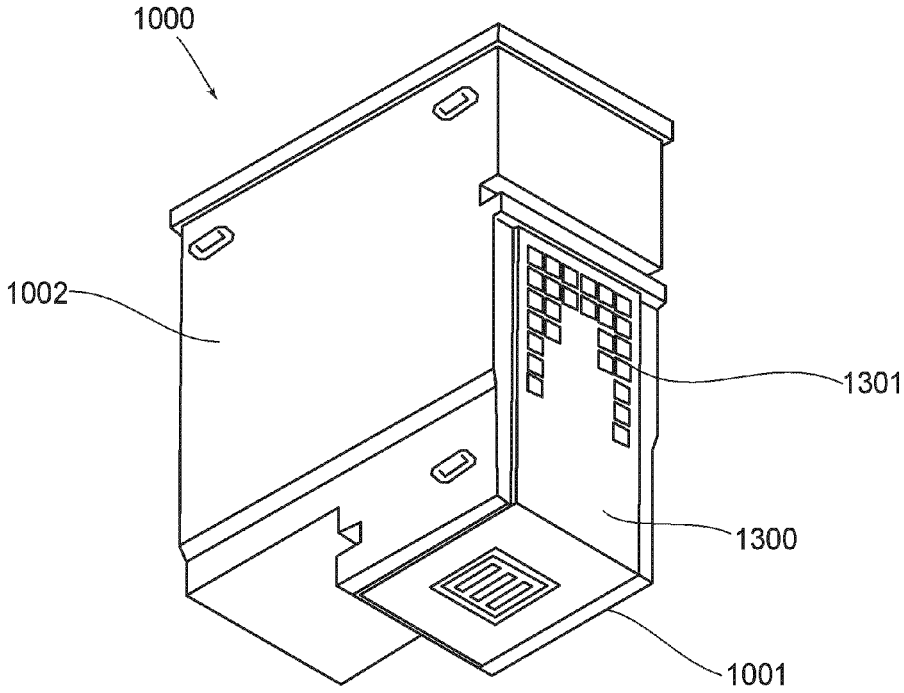
FIG. 1 is a perspective view of an ink jet cartridge of a first embodiment according to the present invention.

FIG. 1 is a perspective view of a print head cartridge according to the embodiment of the present invention, wherein a printing head portion 1001 has a recording element substrate 1100 for ejecting an ink droplet by creating the film boiling by heating the ink by an electrothermal transducer element which has a heat generating resistor. It comprises an electrical wiring substrate 1300 for applying the driving signal from a printer and so on to the recording element substrate

1100, and a supporting member 1500 which is provided with an ink passage for supplying the ink to the recording element substrate 1100 and which is connected with an ink container portion 1002.

Figure 2:
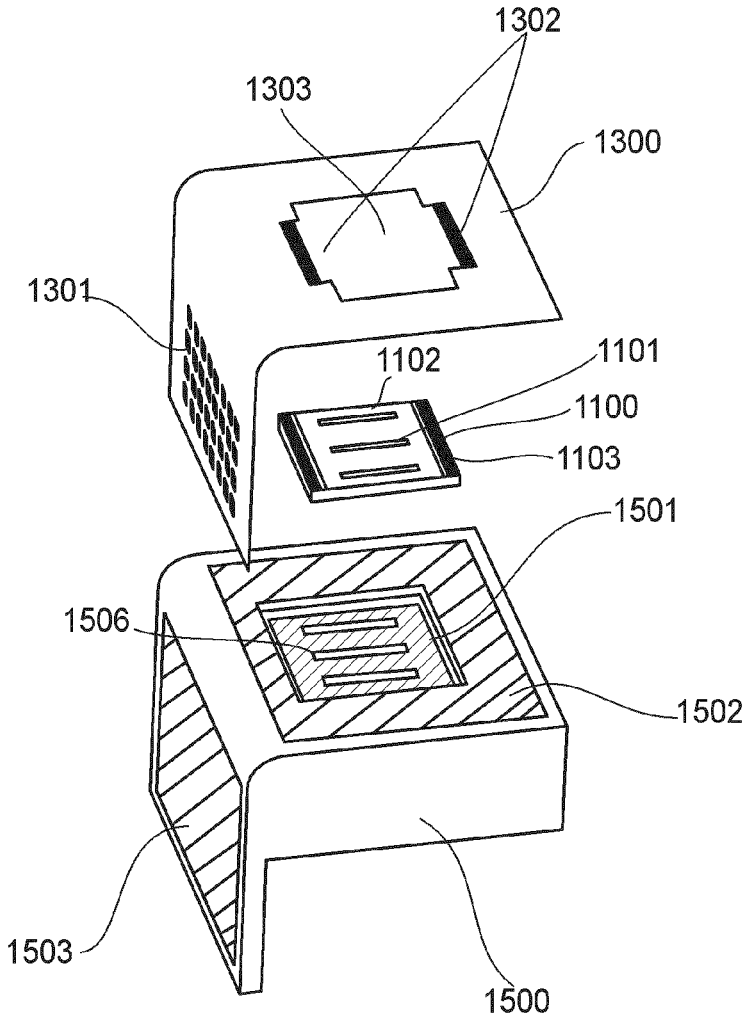
FIG. 2 is an exploded perspective view of a printing head portion according to the first embodiment of the present invention.

FIG. 2 is an exploded perspective view of the printing head portion 1001.

As shown in FIG. 2, on a major surface of the recording element substrate 1100, a nozzle plate 1102 provided with the ejection outlets 1101 and an electrode portion 1103 are provided. An opening 1303 of the electrical wiring substrate 1300 has a configuration for receiving them, and it is fixed by a first adhesive material 1501 so that an ink supply port of the recording element substrate 1100 corresponds to an ink supply port 1506 which is an exit of a flow path on the supporting member 1500. The electrical wiring substrate 1300 is fixed to a supporting member 1500 by the second adhesive material 1502, the electrode portion 1103 of an inner lead 1302 and a recording element substrate disposed at the opening 1303 are connected with each other. The inner lead 1302 and the electrode portion 1103 are electrically connected with each other by TAB implementation technique disclosed in JP 10-000776A, for example. In the electrical wiring substrate 1300, a portion which has a contact portion 1301 for receiving the driving signal from the printer and so on is bonded to a side of the supporting member 1500 by the third adhesive material 1503.

Figure 3A:
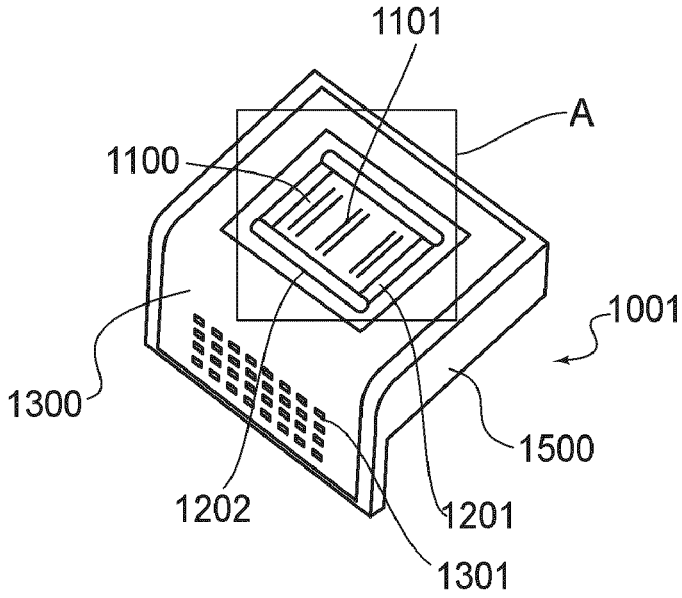
FIG. 3A is a general arrangement.
Figure 3B:
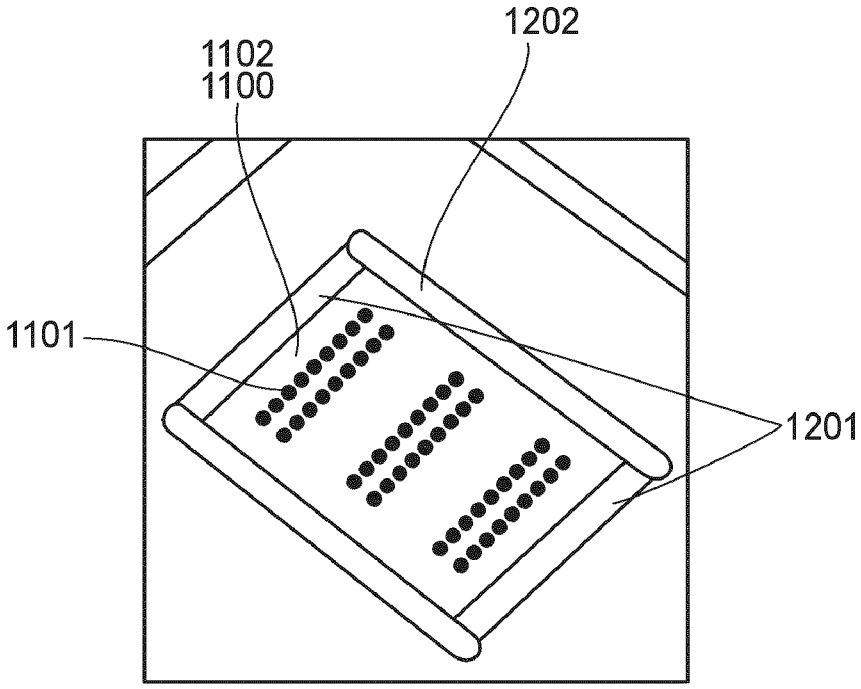
FIG. 3B is an enlarged view of an A portion shown in the FIG. 3A.

FIG. 3 is a perspective view of the printing head portion 1001, wherein FIG. 3A is a general arrangement and FIG. 3B is an enlarged view of the A portion of FIG. 3A. As shown in the Figure, the circumference of a side of the recording element substrate 1100 is sealed with the first sealant 1201, and an electrical connecting portion is sealed with the second sealant 1202, by which the electrical connecting portion is protected from corrosion by the ink and from an external force.

Figure 4:
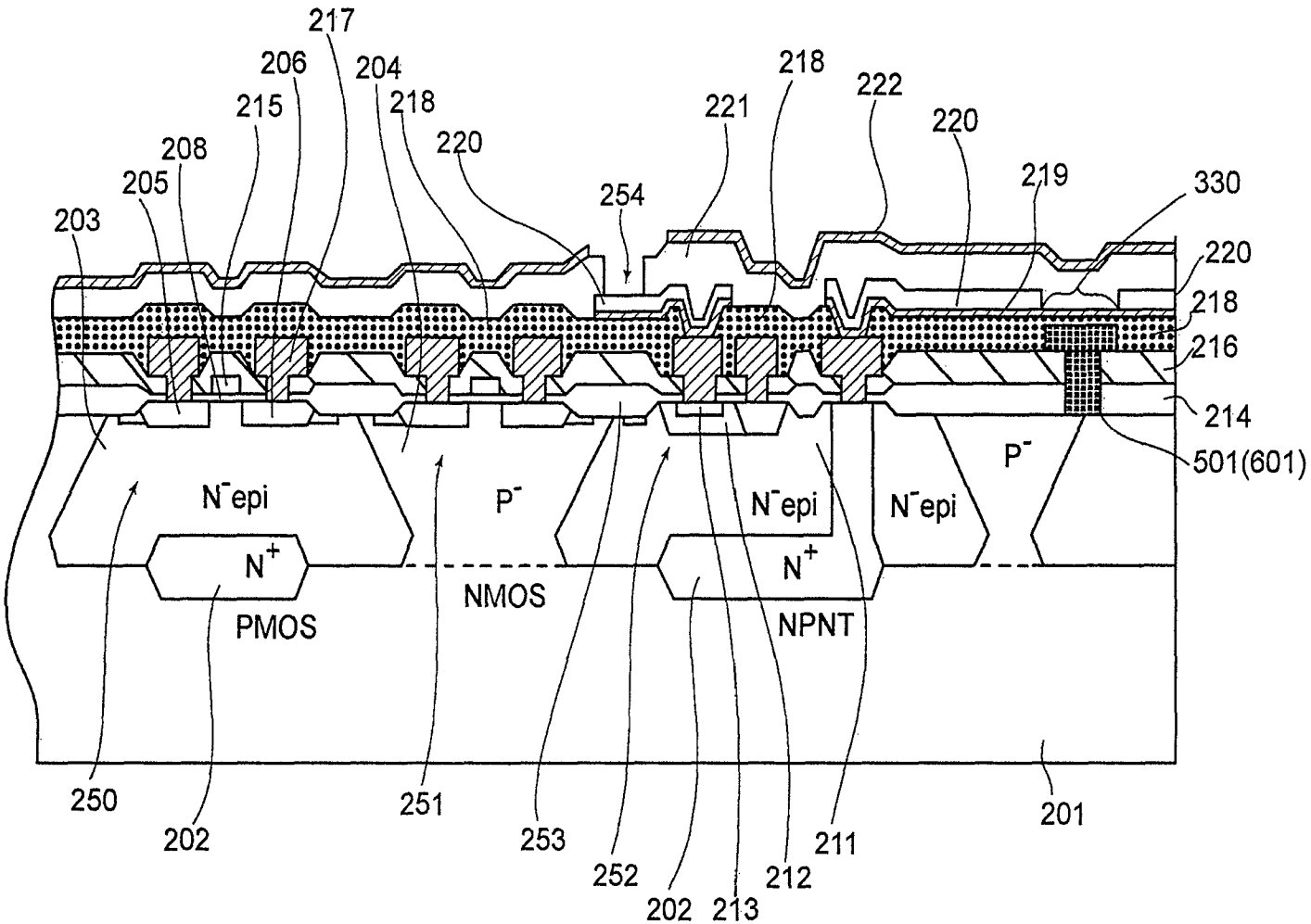
FIG. 4 is a sectional view of a recording element substrate according to the first embodiment of the present invention.

Referring to FIG. 4, the structure of the recording element substrate according to the embodiment of the present invention will be described in detail.

FIG. 4 is a sectional view of the recording element substrate according to the present embodiment.

As shown in FIG. 4, a dopant, such as As, is added by means of ion plantation and diffusion into a Si substrate 201 of P electroconductive member, so that a N type epitaxial layer 203 is formed. Furthermore, impurities, such as B, are added into N type epitaxial layer 203, so that a P type well region 204 is formed. Thereafter, the impurity adding step including the photolithography, the oxide scattering, and the ion plantation is repeated, by which p-MOS250 is formed in N type epitaxial region, and n-MOS251 is formed in a P type well region. p-MOS250 and n-MOS251 it comprises a gate wire 215 of the polysilicon deposited by a CVD method through a gate insulation film 208 which has the thickness of hundreds of A, the source region 205 added with N type or P type impurity, and a drain region 206.

A logic portions, such as a latching circuit and a shift register (S/R), are formed by such a MOS transistor. In addition, a NPN type power transistor 252 which is a driver for a heat generating element is provided by forming a collector region 211, a base region 212, an emitter region 213, and so on in N type epitaxial layer by the steps, such as the impurity introduction and diffusion.

The region between the elements is formed as an oxide film separation region 253 by a field oxidation, by which the separation between the elements is established. This field oxide film functions as a first heat accumulation layer 214 below the heat generating element 255 of a Ta film. After the elements are formed, an interlayer insulation film 216 accumulates in PSG, BPSG by the CVD method, and it is subjected to the smoothing process and so on by a heat treatment. A connecting line for logic circuits 250 and 251 and a connecting line for a power transistor 252 are established by the first aluminum electrode 217 in the first layer through a contact hole.

In the embodiment according to the present invention, as shown in FIG. 4, a first warming resistor 501 is provided as a lower layer of a resistance layer 219 which is an ejecting resistor 300. This first warming resistor 501 may be made from aluminum, and it may be simultaneously made in an aluminum electrode 217 manufacturing method step of the description, or it may make from the polysilicon used for a gate wire of the description. A second warming resistor 601 in the same layer as the first warming resistor is provided in an outer periphery of the recording element substrate. The first warming resistor 501 and the second warming resistor 601 are electrically connected through the connecting line in the same layer to a first heating contact pad 510 and a second heating contact pad 610 in an external signal input terminal 1301 shown in FIG. 5. The heat is produced when a signal is fed to contact pads 510 and 610 from a main assembly.

Thereafter, interlayer insulation films 218, such as SiO, accumulate by a plasma CVD method. A through hole is formed in the interlayer insulation film 218, and a connecting line for the heat conversion element and an aluminum electrode layer 220 for connecting the driving transistor therewith are provided. By this, a heater layer 219 and a second aluminum electrode 220 are formed.

As a protecting film 221, a SiN film is formed by the plasma CVD method. As for a top layer, an anti-cavitation film 222 is accumulated by Ta or the like, and opens in a pad portion 254. Designated by 220 is a second Al (aluminum) electrode. As has been described hereinbefore, "the logic circuit for the selective element drive" including the heat conversion elements, the power transistor for the element drive, the shift register, and a latch is constituted integrally.

Figure 6:
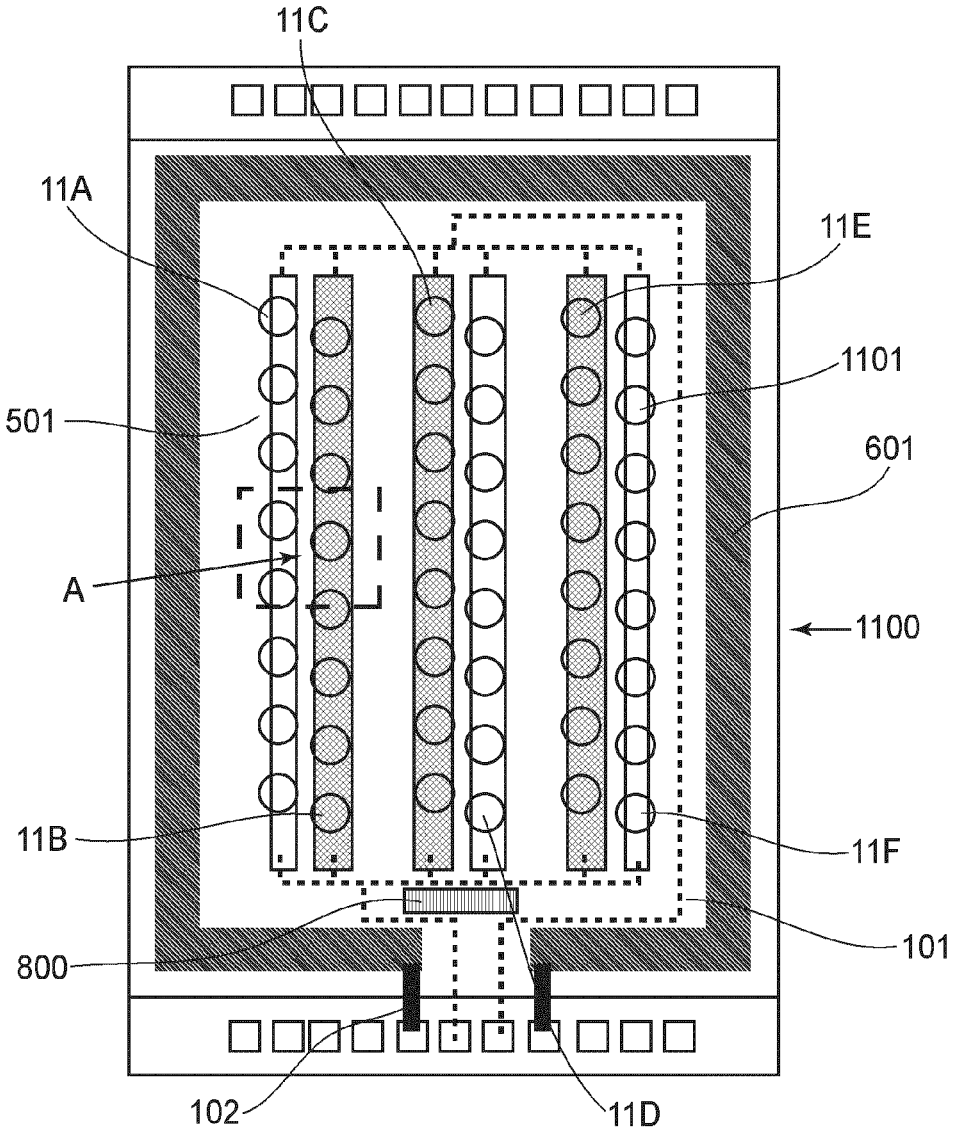
FIG. 6 is an illustration of the recording element substrate according to the first embodiment of the present invention.

FIG. 6 is a top plan view of the recording element substrate 1100 in the present embodiment.

The recording element substrate 1100 has a head temperature sensor 800 for sensing a temperature of the recording element substrate. Although a head temperature sensor is, for example a thermistor, it may be a device of another type if it can sense the head temperature.

In the embodiment according to the present invention, the cyan ink, the magenta ink, and the yellow ink (three color inks) are used. The ejection outlet 1101 has a round form and an ejection outlet diameter thereof is 16.8 micrometers, wherein the one drop (ejection amount of the ink) ejected is about 5.7 ng. An ejection outlet array 11A, 11B ejects the cyan ink, an ejection outlet array 11C, 11D ejects the magenta ink, and an ejection outlet array 11E, 11F ejects the yellow ink. The first warming resistor 501 is provided correspondingly to the ejection outlet array 11A-F, respectively. The first warming resistor 501 is connected by the connecting line 101 in this layer. The width of this first warming resistor is 3 micrometers as an example, and a resistance value thereof is 192 ohms, wherein since a voltage of 24V is applied thereto, an amount of heat generation is approx. 3 W. As shown in FIG. 6, the second warming resistor 601 surrounds a circumference of the recording element substrate. The width of this second warming resistor is, for example, 4 micrometers. This first warming resistor 501 and second warming resistor 601 are electrically connected with the first heating contact pad 510 and the second heating contact pad 610 shown in FIG. 5 as described above, respectively. The first warming resistor 501 generates heat by energizing the first heating contact pad 510. The second warming resistor 601 generates heat by energizing the contact pad 610 for the second heating. With the structure as described above, in this embodiment, the first warming resistor 501 and the second warming resistor 601 can be controlled independently from each other.

Figure 7A:
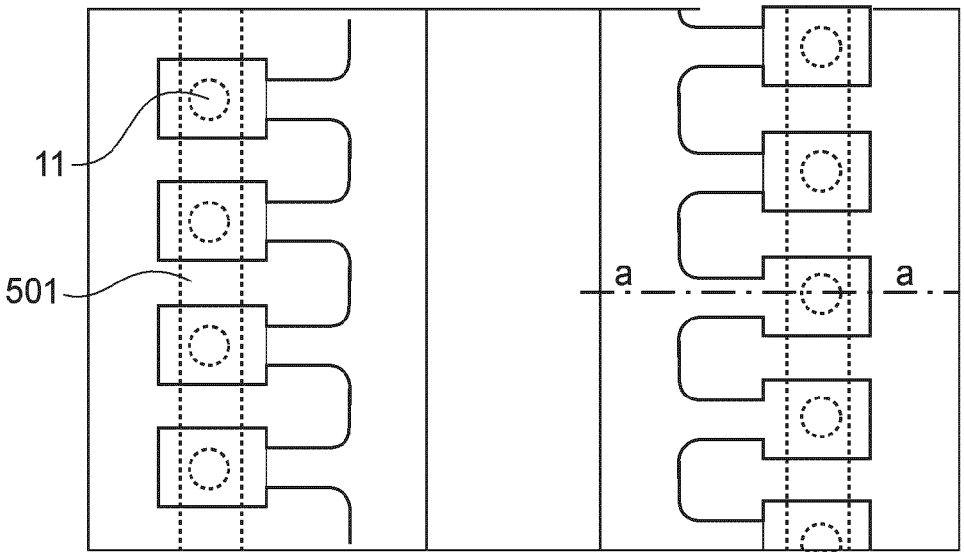
FIG. 7A is an enlarged view of an A portion of FIG. 1.
Figure 7B:
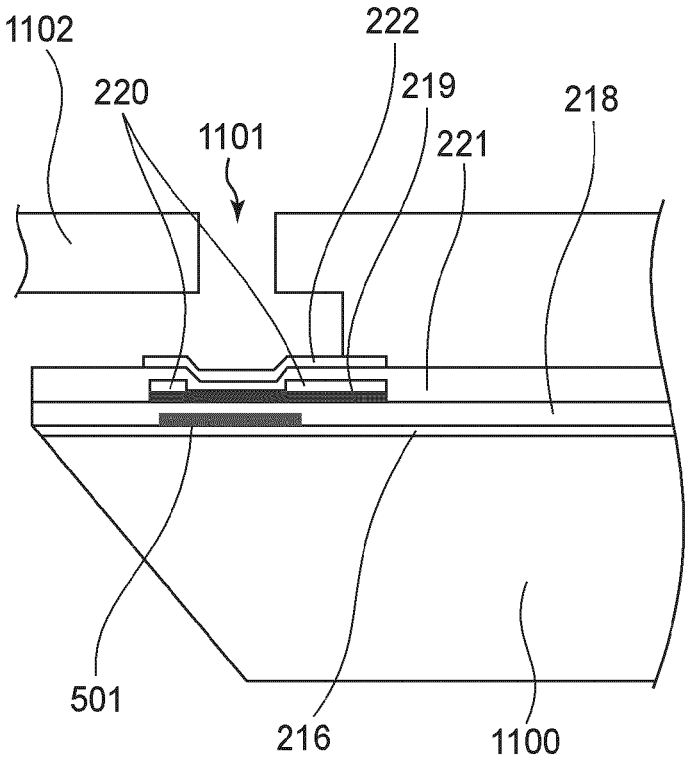
FIG. 7B is an a-a sectional view of FIG. 7A.

FIG. 7 illustrates the position of the first warming resistor, FIG. 7A is an enlarged view of the A portion of FIG. 6, and FIG. 7B is the a-a sectional view of FIG. 7A. As shown in FIG. 7, a part of first warming resistor 501 is provided through the ink flow path portion which communicates directly to the ejection outlet, in order to supply the ink to the ejection outlet 1101. For this reason, the first warming resistor is suitable for heating the ink adjacent to the ejection outlet efficiently. Since a viscosity of the ink used for the present embodiment is reduced with the temperature, the first shot property is improved.

FIG. 8 shows a relation between a head temperature and the first shot property. As shown in this table, when the head temperature which was read by the temperature sensor is 15° C., the continuation of the interrupted state (non-ejection) for the time duration of 0.5 or more scanning operations disturbs the stable ink ejection. However, when the head temperature is 40° C., the stable ejection is maintained also after the interrupted state for the time duration of about 6 scannings. When the head temperature is 50° C., the stable ejection is maintained also after the interrupted state for the time duration of about 7 scannings.

In the present embodiment, the operations in the case where the recording instructions are supplied will be described.

Figure 9:
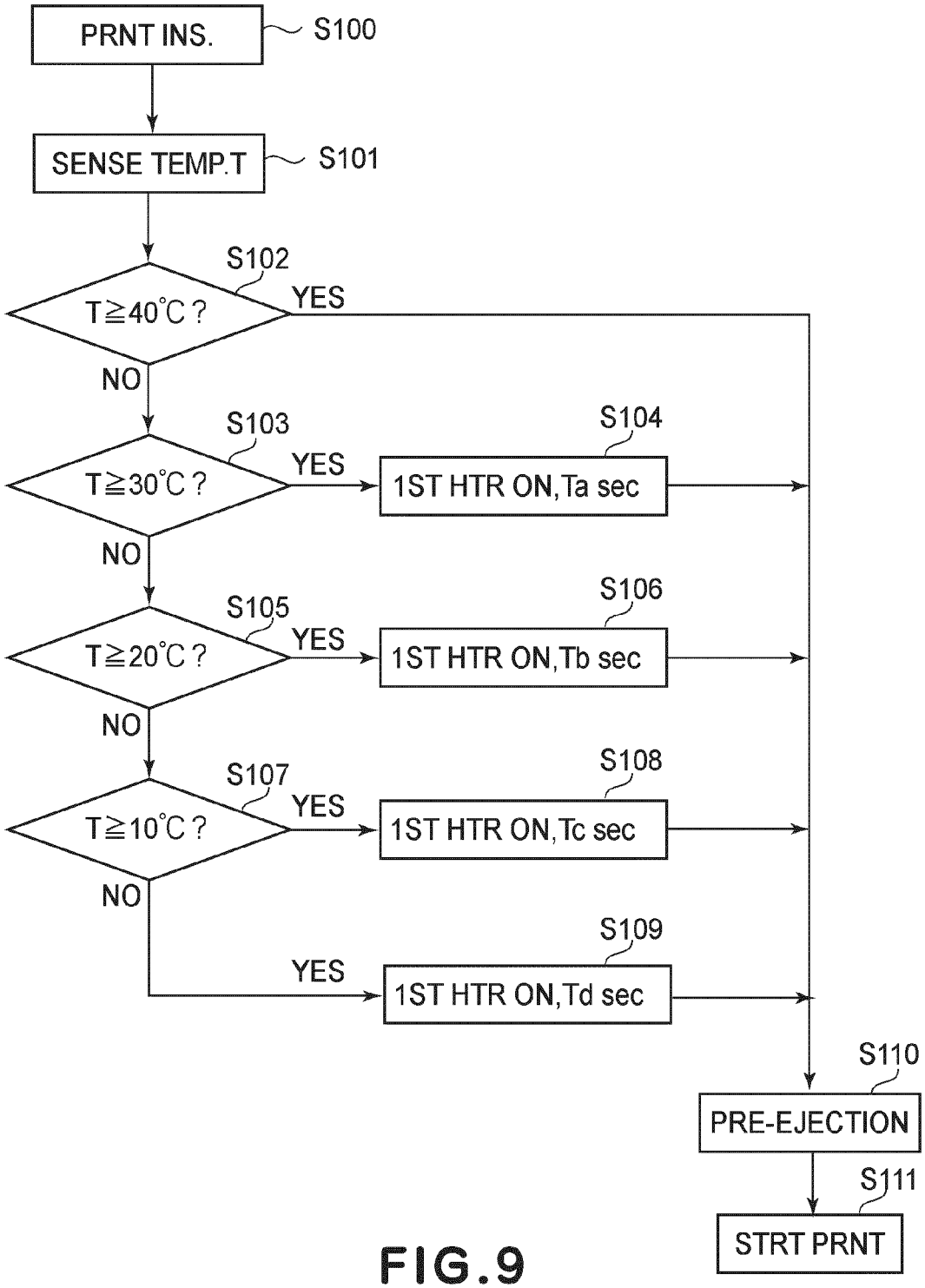
FIG. 9 is a flow-chart diagram illustrating a temperature control process at the time of a recording instructions according to the first embodiment of the present invention.

FIG. 9 is a flow-chart diagram of a temperature control process at the time of a recording instructions according to the first embodiment of the present invention. As described above, the viscosity of the ink used for the present invention is reduced with the rising of the temperature, and the first shot property is improved. As described above, when the head temperature is 40° C., after the preliminary ejection, if the interrupted state is about 6 or less scanning, the ink can be ejected stably. Referring to FIG. 9, a specific operation from the recording instructions to the recording start (just before the recording start) in the present embodiment will be described. When the recording instructions (step S100) is produced, the head temperature sensor 800 (FIG. 6) senses a current head temperature (step S101). A refreshing operation, such as the suction, may be carried out after the step S100. In the case of the head temperature as a result of a temperature sensing being 40° C. or high, a preliminary ejection is carried out as shown in the steps S102, S110, S111, and a recording operation is started. Since the head temperature is 40° C. or higher, even if the interrupted state continues for about 6 scannings, the stable ejection can be performed after the preliminary ejection.

When the head temperature is not lower than 30° C. and lower than 40° C., the operation advances to the steps S103, S104, wherein the first warming resistor 501 carries out the heat generation for Ta second to raise the ink temperature by about 10° C. The Ta second is a heating time required to raise the ink temperature by about 10° C., and it is about 0.5 second here. Since a part of the first warming resistor is positioned below ink passage communicated with the ejection outlet in order to supply the ink to an ejection outlet, the ink is heated efficiently. As a result, the temperature of the ink in the ejection outlet array 11 reaches about 40° C. Thereafter, the preliminary ejection (step S110) is carried out and a record starting operation (step S111) is carried out.

When the temperature of the head is not lower than 20° C. and lower than 30° C., the operation advances to the steps S105, S106, wherein the first warming resistor 501 is energized for Tb (>Ta) second. The Tb second is the heating time required to raise the ink temperature by about 20° C. Thereafter, the preliminary ejection (step S110) is carried out and the recording (step S111) is started. At this time, the temperature of the ink in the ejection outlet array 11 is about 40° C.

Similarly, as to the case where the head temperature is not lower than 10° C. and lower than 20° C., in order that the first warming resistor 501 raises the ink temperature by about 30° C., it energize for the Tc (>Tb) second, and the record starting operation is carried out after the preliminary ejection (steps S107, S108, S110, S111).

When the head temperature is 10° C. or lower, the first warming resistor 501 is energized for the Td (>Tc) second for raising the ink temperature by about 40° C. Thereafter, the preliminary ejection is carried out and the record starting operation is carried out (steps S107, S109, S110, and S111).

The recording can be started by a control as described above, with the preferable temperature, i.e., head temperature of about 40° C.

Figure 10:
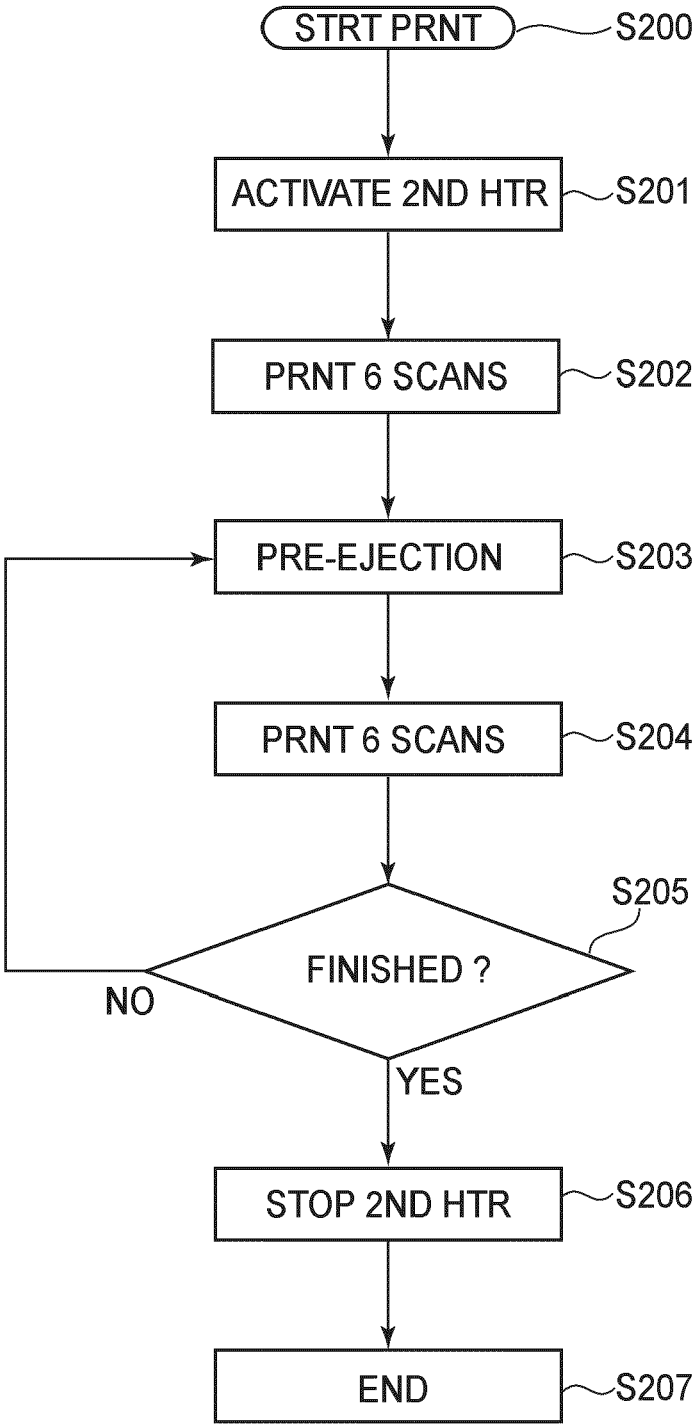
FIG. 10 is a flow-chart diagram illustrating a temperature control process after the recording start according to the first embodiment of the present invention.

The description will be made about the operation after the recording start referring to FIG. 10. When the recording is started (step S200), the operation 1 advances to a step S201, in which the second warming resistor 601 starts the heat generating operation. As shown in FIG. 6, the second warming resistor 601 is provided so that it surrounds the circumference of the recording element substrate 1100, and therefore, it can warm effectively the end of the recording element substrate 1100 which exhibits large heat radiation, and prevents the temperature reduction by the heat radiation. Furthermore, it warms a whole recording element substrate and makes a temperature distribution substantially uniform. With the heated ink by the second warming resistor in the end of a substrate, the recording operation through the six scannings is carried out as shown in the step S202. At this time, as described above, since the head temperature is about 40° C., the stable ejection is carried out. When the recording for the six scannings (step S202) is finished, the operation advances to a step S203, in which the preliminary ejection is carried out and the recording operation of 6 scannings is carried out again (step S204). When the recording operation of the step S204 finishes, the operation advances to a step S205, in which the discrimination is made about whether all the recording operations have finished, and, if not, the operation returns to the step S203 and the preliminary ejection is carried out again, if so, energization of the second warming resistor is stopped (step S206), and the operation is finished (step S207).

As described above, at the time of a recording operation start, by energization of the first warming resistor, the ink is warmed, by which the first shot property is improved. In addition, by the recording operation, while making the second warming resistor generate heat, since a production of the temperature difference between the end and a central portion in the inside of the recording element substrate due to the heat radiation from the end of a recording element substrate can be suppressed, so that the ink ejection property in the recording element substrate can be made uniform. Accordingly, it is possible to suppress deterioration of the image quality, such as the strips and the non-uniformity due to variation of the color density or the color tone, of the image recorded on a medium.

Second Embodiment

The ink jet recording head used for the present embodiment is the same as that of the first embodiment. In the description of this embodiment, the same reference numerals as in Embodiment 1 are assigned to the elements having the corresponding functions in this embodiment, and the detailed description thereof is omitted for simplicity.

Figure 11:
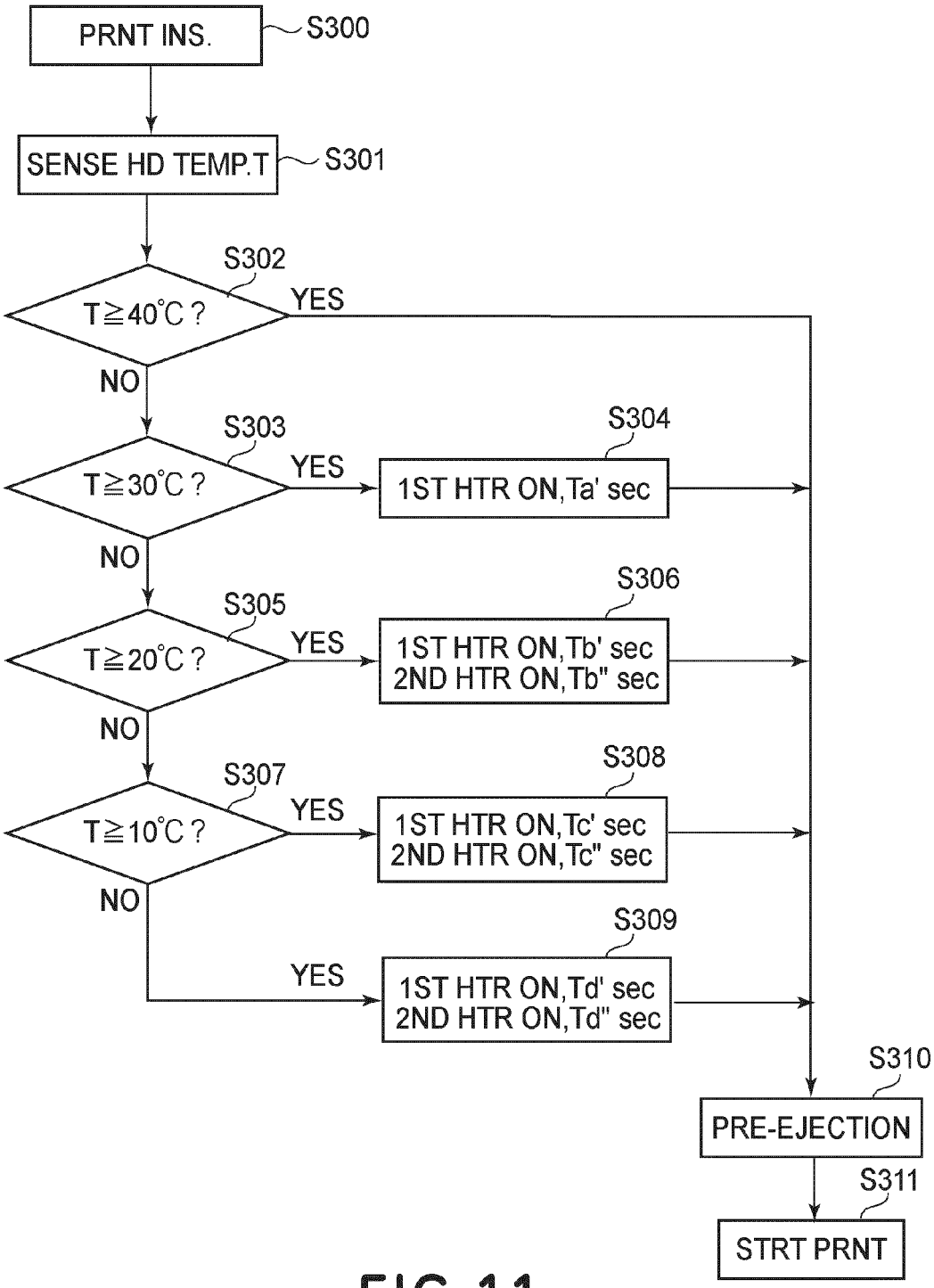
FIG. 11 is a flow-chart diagram illustrating a temperature control process at the time of the recording instructions according to the first embodiment of the present invention.

FIG. 11 is a flow-chart diagram of a head temperature control process at the time of the recording instructions according to the first embodiment of the present invention.

Referring to FIG. 11, the specific operation from the recording instructions in the present embodiment to the recording start will be described.

When the recording instructions (step S300) is produced, the head temperature sensor 800 (FIG. 6) senses the current head temperature (step S301). The refreshing operations, such as the suction, may be carried out after the step S300. When the head temperature as a result of the temperature sensing is 40° C. or higher, the operation advances to the steps S302, S310, S311, wherein the preliminary ejection is carried out and the recording operation is started. Since the head temperature is 40° C. or higher, even if the non-ejection state continues through about 6 scannings, the ink is stably ejected after the preliminary ejection.

When the head temperature is not lower than 30° C. and lower than 40° C., the operation advances to the step S303, 304, wherein as in the case of the first embodiment, only the first warming resistor 501 is energized for Ta' second to raise the ink temperature by about 10° C. The Ta' second is the heating time required to raise the ink temperature by 10° C., and it is about 0.5 second in the present embodiment. As a result, the temperature of the ink in the ejection outlet array 11 reaches about 40° C. Thereafter, the preliminary ejection (step S310) is carried out and the record starting operation (step S301) is carried out.

When the head temperatures is not lower than 20° C. and lower than 30° C., the operation advances to the steps S305, 306, in which the first warming resistor is energized for Tb' (<Tb) second, and, and the second warming resistor are energized for the Tb" (≦Tb") second. By also energizing the second warming resistor in addition to the first warming resistor, the about 20° C. temperature rise can be accomplished by the time shorter than the time Tb which the energization of only the first warming resistor of the first embodiment takes.

In the first embodiment, as has been described in the foregoing, the resistance value of the first warming resistor is larger than the resistance value of the second warming resistor. Furthermore, the first warming resistor is provided in the position nearer to ejection outlet than the second warming resistor. Therefore, the first warming resistor can raise the temperature of the ink in a shorter time. For this reason, it is preferable to use the second warming resistor as auxiliary means from the viewpoint of raising the temperature. Therefore, the heat generating time of the first warming resistor Tb' is preferably longer than or the same as the heat generating time Tb" of the second warming resistor. It is preferable that the amount of heat generation of the first warming resistor is larger than the amount of heat generation of the second warming resistor. In addition, the temperature difference can be removed by making the second warming resistor generate heat. Thereafter, the operation advances to the step S310 and the step S311, in which the record starting operation is carried out after the preliminary ejection.

Similarly, in the case of the head temperature being not lower than 10° C. or lower than 20° C., the operation advances to the steps S307, S308, wherein the first warming resistor 501 is energized for Tc' second, and the second warming resistor is energized for the Tc" second. By doing so, the ink temperature is raised by about 30° C. Similarly to the case where the head temperature is not lower than 20° C. and lower than 30° C., it is preferable that Tc"≦Tc'<Tc is satisfied, and it is preferable that the amount of heat generation of the first warming resistor is larger than the amount of heat generation of the second warming resistor. Thereafter, the operation advances to the step S310 and the step S311, in which the preliminary ejection and the record starting operation are carried out.

Similarly, when the head temperature is 10° C. or lower, the first warming resistor 501 is energized for Td' second, and the second warming resistor is energized for the Td" second to raise the ink temperature to about 40° C. It is preferable to satisfy Td"≦Td'<Td, and it is preferable that the amount of heat generation of the first warming resistor is larger than the amount of heat generation of the second warming resistor. Thereafter, the preliminary ejection and the record starting operation are carried out in the step S310 and the step S311.

By the control as described above, the recording operation can be started without the preliminary ejection for the duration of about 6 scannings with about 40° C. which is the ink temperature with which the stable image forming operation is possible. Furthermore, the temperature can be raised in the shorter time, than in the case of the usage of only the first, warming resistor by energizing the second warming resistor in addition to the first warming resistor.

Figure 12:
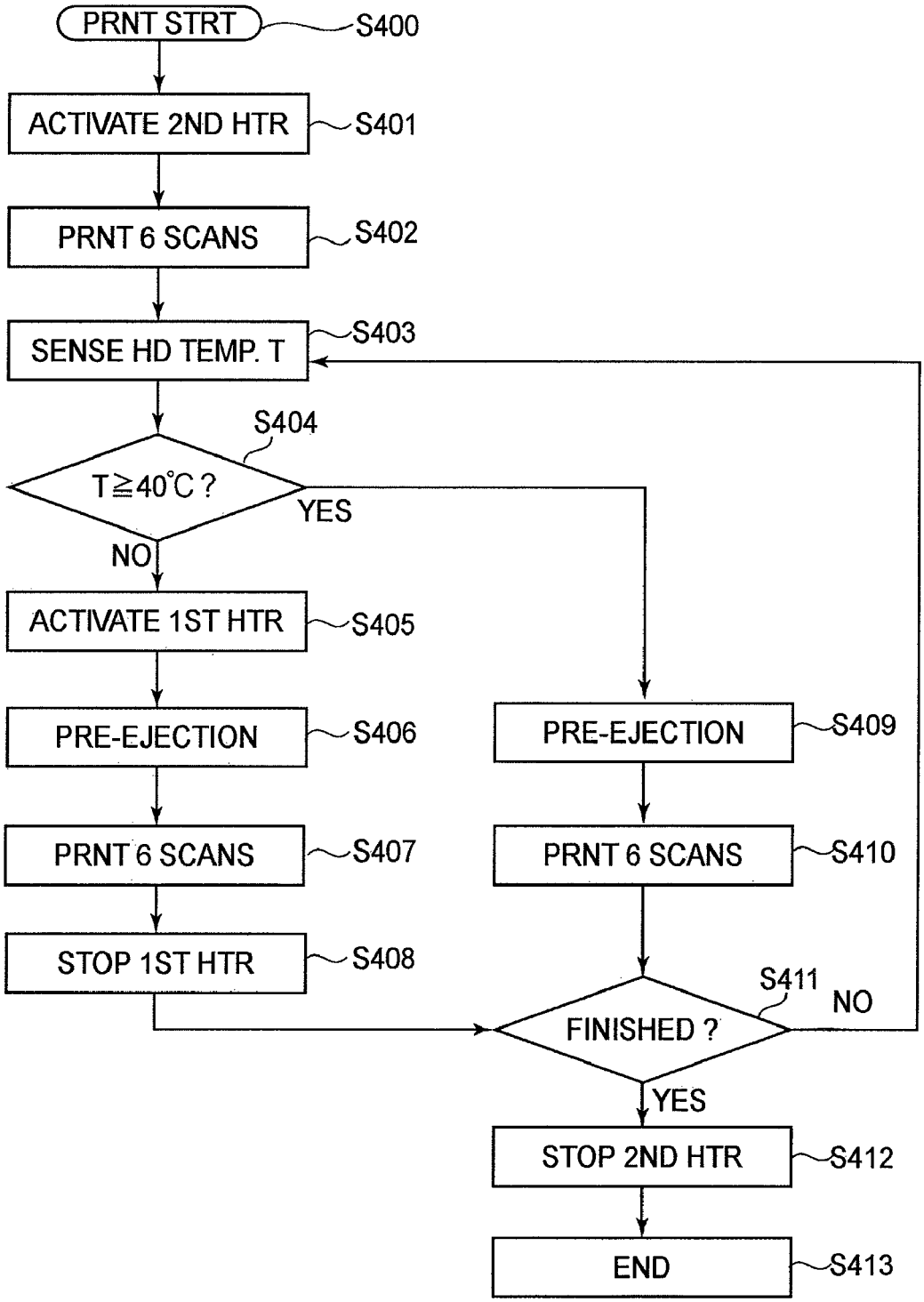
FIG. 12 is a flow-chart diagram illustrating a temperature control process after the record starting operation according to the first embodiment of the present invention.

The description will be made about the operation after the recording start referring to FIG. 12. When the recording is started (step S400), the energization of the second warming resistor 601 is started as shown in a step S401. The second warming resistor 601 is provided so that it surrounds the circumference of the recording element substrate 1100 as shown in FIG. 6, and therefore, the end of the recording element substrate 1100 which exhibits the large heat radiation can be warmed effectively. By this, the ink in the end of the substrate can also be warmed and the recording operation for the six scannings (step S402) is carried out in this state. At this time, as described above, since the head temperature is about 40° C., the stable ejection can be performed. The temperature is sensed by the head temperature sensor when the recording for the six scannings (step S402) is finished (step S403). In the case of the head temperature being 40° C. or more, the preliminary ejection (step S409) is carried out and the recording operation for the additional 6 scannings is carried out. Since the head temperature is 40° C. or higher, the stable ejection sufficiently is possible. In the case of the head temperature being lower than 40° C. in the step S404, the operation advances to the step S405 and starts the energization of the first warming resistor. The head temperature is effectively raised by energizing the first warming resistor in addition to the second warming resistor. Thereafter, the preliminary ejection (step S406) is carried out, and the recording operation (step S407) for further six scannings is carried out, and the energization of the first warming resistor is stopped.

When the step S408 or the step S410 finishes, the discrimination is made about whether all the recordings are finished in a step S411. If not, the operation returns to the step S403, wherein a preliminary ejection is carried out again. If so, the energization of the second warming resistor is stopped (step S412), and the operation finishes (step S413).

As described above, the desirable heating is accomplished by controlling the amount of heat generation of the first warming resistor and the second warming resistor in response to the head temperature.

Third Embodiment

In the description of this embodiment, the same reference numerals as in Embodiments 1 and 2 are assigned to the elements having the corresponding functions in this embodiment, and the detailed description thereof is omitted for simplicity.

Figure 13:
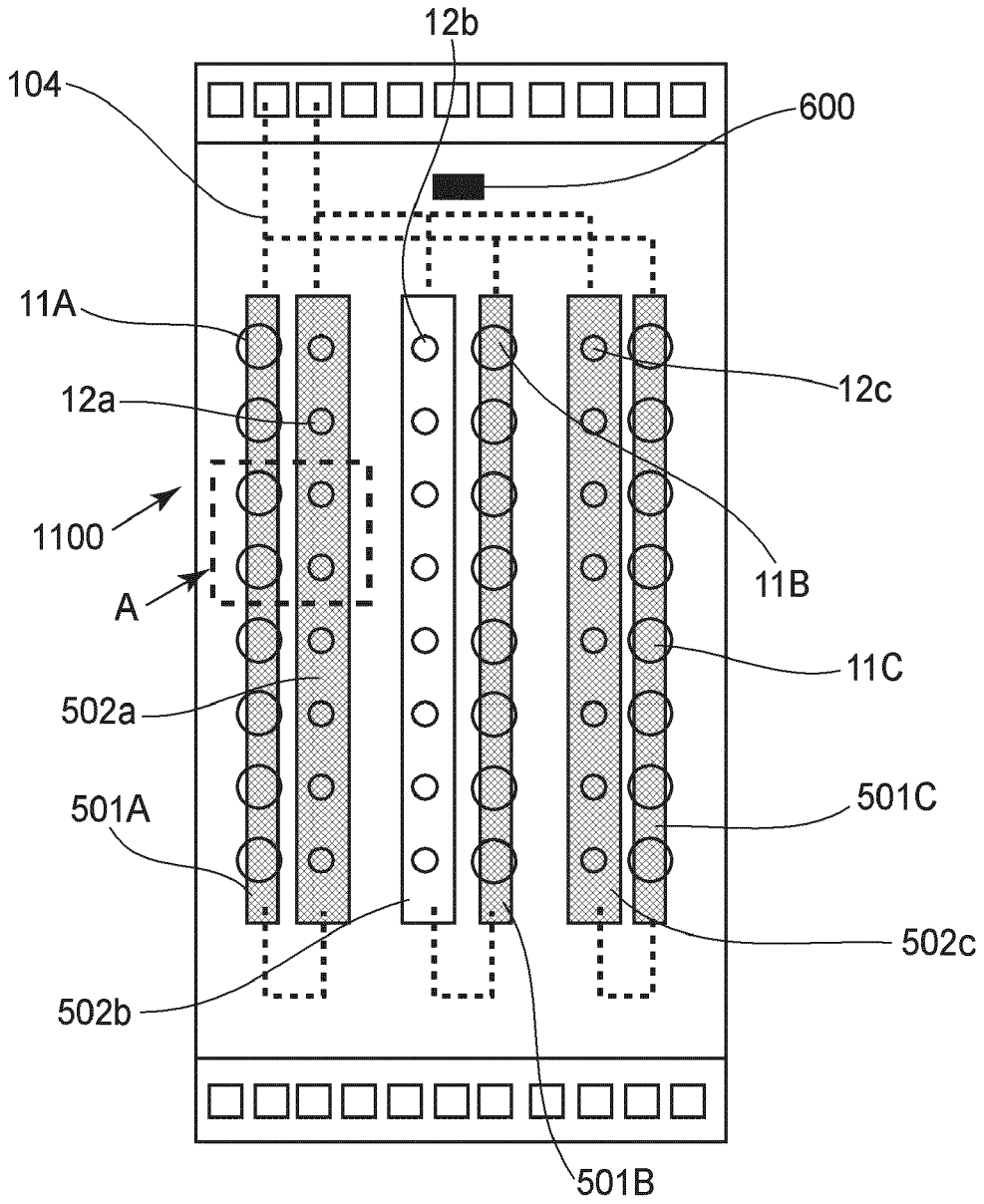
FIG. 13 illustrates a recording element substrate in a third embodiment according to the present invention.

FIG. 13 is a top plan view of a recording element substrate in the present embodiment. This recording element substrate 1100 is provided with a first ejection outlet array 11 which has relatively large ejection outlets, and a second ejection outlet array 12 which has relatively small ejection outlets. The ejection outlet has the round form, the first ejection outlet diameter is 16.8 micrometers, and the second ejection outlet diameter is 11.6 micrometers, wherein the ejection amounts of the one drop of ink ejected from the first ejection outlet are about 5.7 ng, and the ejection amounts of the one drop of ink ejected from the second ejection outlet are about 2.5 ng. The adjacent ejection outlet arrays 11A and 12*a* eject the cyan ink, the adjacent ejection outlet arrays 11B and 12*b* eject the magenta ink, and the adjacent ejection outlet arrays 11C and 12*c* eject the yellow ink. As shown in FIG. 13, the first warming resistors 501A-501C are provided for the ejection outlet arrays 11A-11C, and the second warming resistors 502*a*-502*c* are provided for the ejection outlet arrays 12*a*-12*c*.

In this embodiment, the second warming resistor 502 which comprises a polysilicon layer has a wiring width of 190 micrometers and 1.6 micrometers of a connecting line thickness, and the first warming resistor 501 comprising an aluminum layer has a wiring width of 1.5 micrometers and 0.8 micrometer of a connecting line thickness. In this embodiment, in the pair of warming resistors, the warming resistors are connected with each other in series, wherein the amount of heat generations of the firsts and second warming resistors by an applied voltage of 24V are about 0.5 W and about 0.75 W, respectively.

Figure 14A:
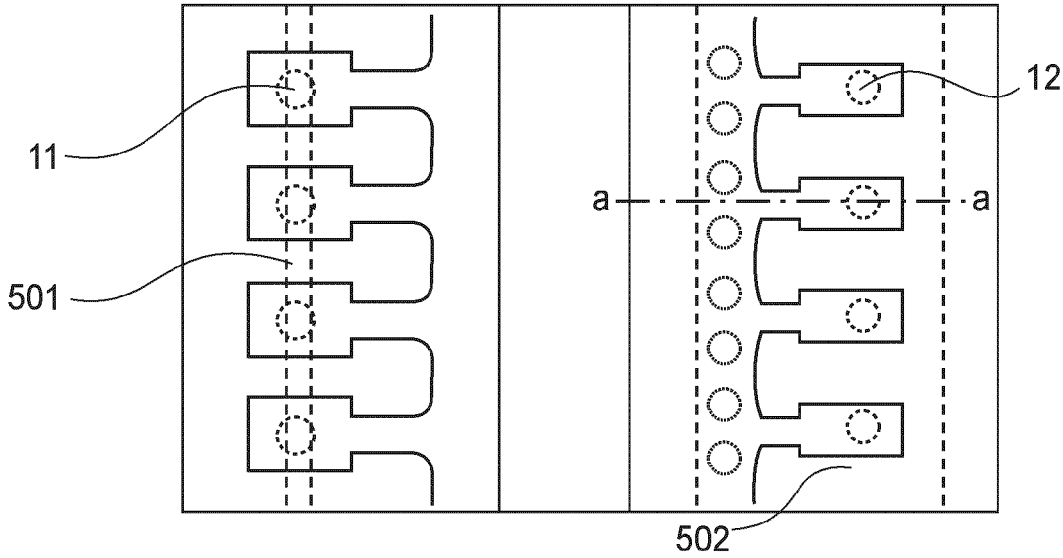
FIG. 14A is an enlarged view of an A portion of FIG. 13.
Figure 14B:
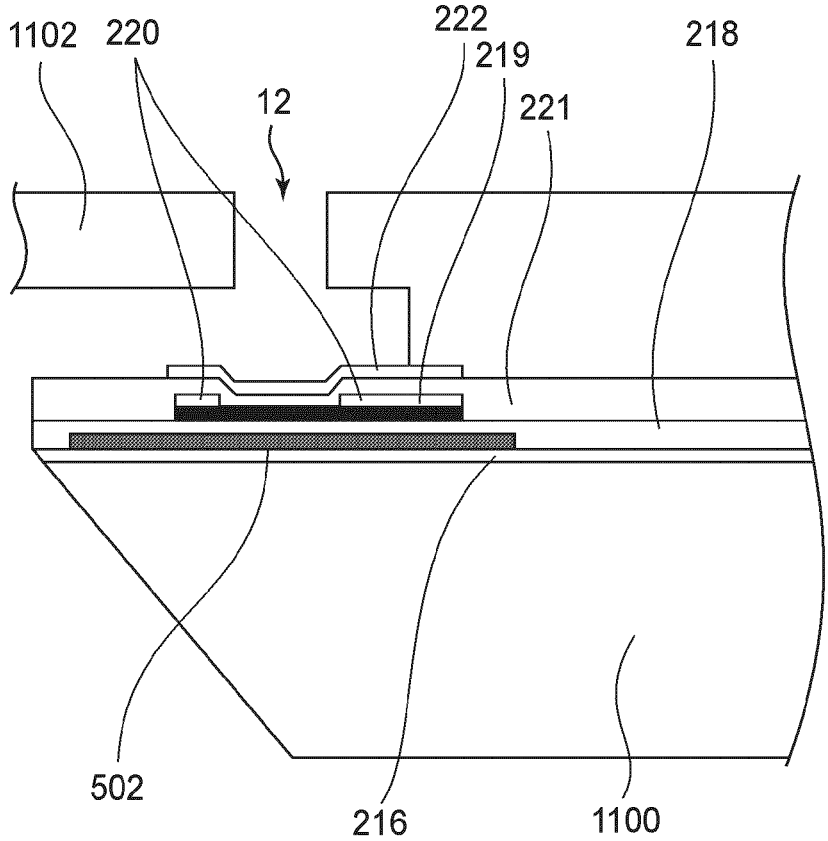
FIG. 14B is an a-a sectional view of FIG. 14A.

FIG. 14 illustrates the position of the warming resistor, FIG. 14A is an enlarged view of an A portion of FIG. 13, and FIG. 14B is an a-a sectional view of FIG. 13A. As shown in FIG. 13, a part of each of the warming resistors 501, 502 are positioned below the ink flow path portion which communicates with the ejection outlet in order to supply the ink to the ejection outlets 11 and 12.

Figure 15:
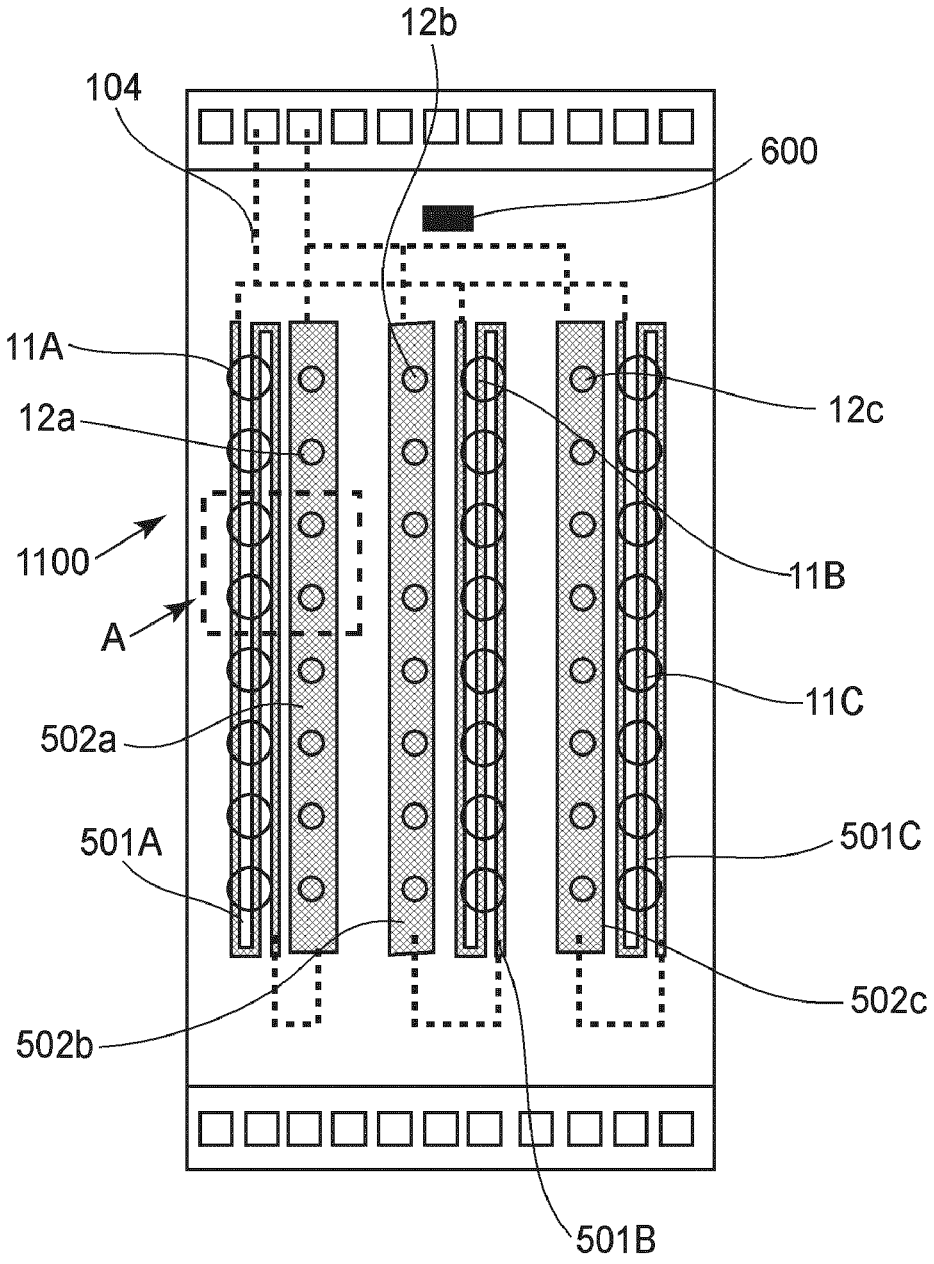
FIG. 15 illustrates another example of the recording element substrate according to the first embodiment of the present invention.

As shown in FIG. 15, a wiring width (range) occupied by the first warming resistor 501 may be large (about 4.5 micrometers), and the first warming resistor 501 may include the three heat generating resistors connected in series in the position corresponding to the first ejection outlet array 11. Also in this case, the connecting line thickness is 0.8 micrometer and the amount of heat generation by the applied voltage of 24V is approx. 0.5 W.

Figure 16A:
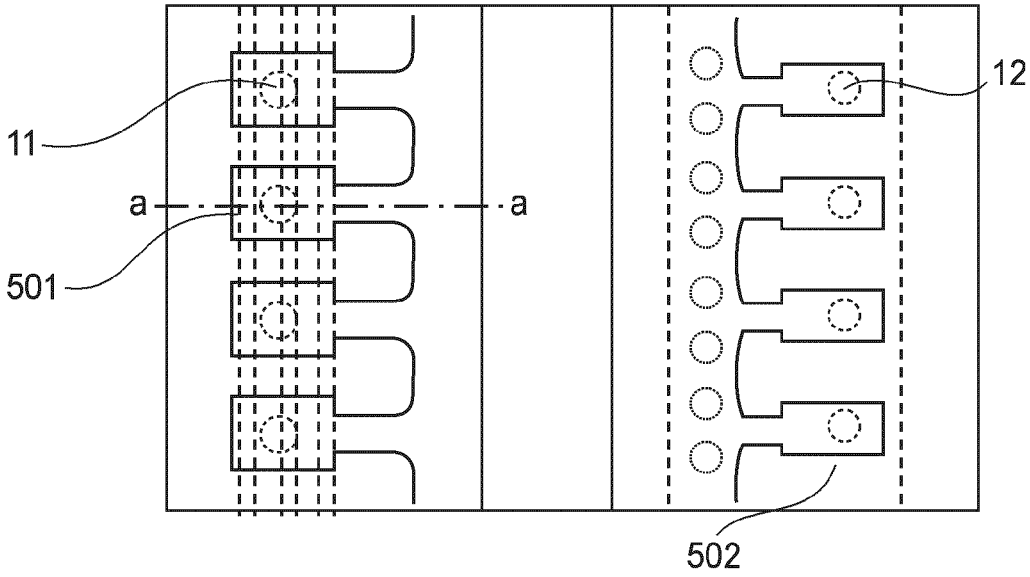
FIG. 16A is the enlarged view of an A portion of FIG. 15.
Figure 16B:
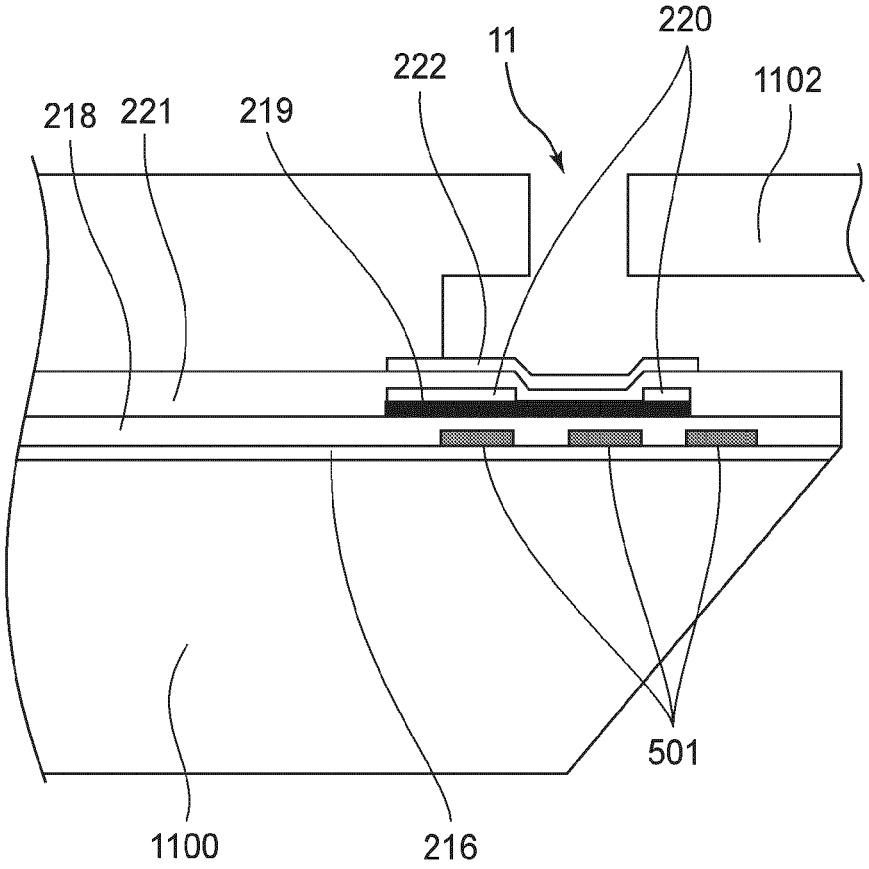
FIG. 16B is an a-a sectional view of FIG. 16A.

FIG. 16 illustrates the position of the warming resistor, FIG. 16A is an enlarged view of the A portion of FIG. 15, and FIG. 16B is the a-a section of the FIG. 16A. Since the wiring width (range) occupied by the first warming resistor 501 is 4.5 micrometers, the influence to a wiring resistance due to a line breadth tolerance is small. In addition, since 3 wiring lines are employed, the wide range can be heated. Since a viscosity of the ink used for the present embodiment decreases with increase of the temperature, the first shot property becomes satisfactory.

FIG. 17 shows the relation between the head temperature and the first shot property with respect to the first ejection outlet and the second ejection outlet. As shown in this table, under the 15 degree-C ambient condition, the ink ejection stabilizes neither in the ink ejected from the first ejection outlet, nor in the ink ejected from the second ejection outlet, after the non-ejection for duration of 0.5 or more scanning.

However, as has been confirmed, when the head is heated to about 40° C., the ink ejected from the first ejection outlet is stably ejected also even after the non-ejection for the duration of about 6 scannings. Also as has been confirmed, when the head is heated to about 40° C., the ink can be stably ejected from the second ejection outlet also after the non-ejection of the about 3 scannings. Also as has been confirmed, when the head is heated to about 50° C., the ink can be stably ejected from the second ejection outlet also after the non-ejection of the about 6 scannings.

Figure 18:
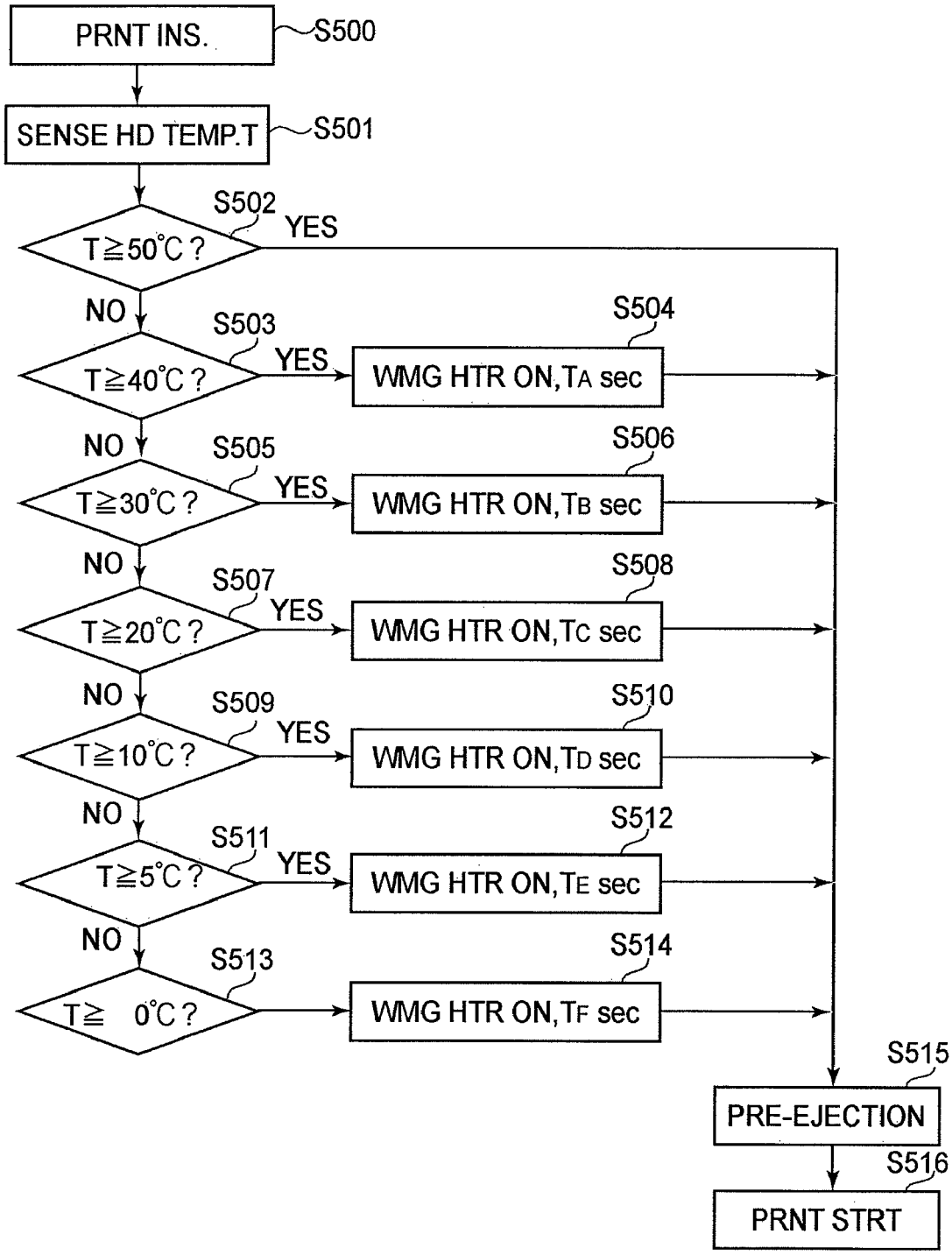
FIG. 18 is a flow-chart diagram which shows a temperature control process at the time of the recording instructions according to the first embodiment of the present invention.

Referring to FIGS. 18 and 19 the specific operation of the operation until the recording is started after the recording instructions is produced in the present embodiment is shown. FIG. 18 is a flow-chart diagram, FIG. 19 is a table showing the relation between the energization time of the warming resistors and the temperature rise of the ink by the first warming resistor and the temperature rise of the ink by the second warming resistor in the present embodiment.

As shown in FIG. 18, the current head temperature is sensed by a head temperature sensor 600 (FIG. 13) when the recording instructions is produced (step S500). As a result, as shown in the steps S502, S515, S516, in the case of the head temperature being 50° C. or higher, the ink can be stably ejected also after the non-ejection between the about 6 scannings, and therefore, the recording operation is started after carrying out the preliminary ejection.

In the case of the head temperature being not lower than 40° C. and lower than 50° C. in the steps S503, S504, the first and the second warming resistors are energized during the TA second. By this, the ink in the second ejection outlet is heated to the temperature more than 50° C. with which the ink can be ejected stably also after the non-ejection for the duration corresponding to about 6 scannings.

Here, the first warming resistor and the second warming resistor are connected with each other in series by the connecting line 104, and a resistance ratio between the first warming resistor and the second warming resistor is 2:3, that is, the ratio of the amounts of heat generation thereof is substantially 2:3. For this reason, as shown in FIG. 19, when the ink temperature corresponding to the second warming resistor is raised by about 10° C., the temperature of the ink corresponding to the first warming resistor also rises by about 7° C.

Then, the preliminary ejection is carried out, and the record starting operation is carried out, by which since the temperature of the ink corresponding to the first ejection outlet is about 40° C., and the temperature of the ink corresponding to the second ejection outlet is about 50° C., it can eject the ink stably also after the non-ejection for the duration corresponding to about 6 scannings.

Similarly, in the case where the head temperatures are not lower than 30° C. and lower than 40° C., the firsts for TB second and the second warming resistors are energized (steps S505, S506) so that the ink corresponding to the first ejection outlet is about 40° C., and the ink corresponding to the second ejection outlet is about 50° C. The this TB second is the time taken for the temperature of the ink corresponding to the first ejection outlet and the temperature of the ink corresponding to the second ejection outlet to rise by about 13° C. and about 20° C., respectively. Then, the preliminary ejection is carried out, and the record starting operation is carried out, by which the ink corresponding to the first ejection outlet is about 40° C., and the ink corresponding to the second ejection outlet is about 50° C., and therefore, the ink can be stably ejected also after the non-ejection for the time corresponding to about 6 scannings.

Similarly, in the case of the head temperature being not lower than 20° C. and lower than 30° C., the first and second warming resistors are energized for TC seconds (steps S507, S508). The TC second is the time which required by 20° C. of temperature rises of the ink corresponding to the first ejection outlet and about 30° C. of temperature rises of the ink corresponding to the second ejection outlet. Then, the preliminary ejection is carried out and the recording operation is started.

Similarly, in the case of the head temperature being not lower than 10° C. and lower than 20° C., the first and second warming resistors are energized for TD seconds (steps S509, S510). The TD second is the time which is required by 30° C. of temperature rises of the ink corresponding to the first ejection outlet and about 45° C. of temperature rises of the ink corresponding to the second ejection outlet. Then, the preliminary ejection is carried out, and the recording operation is started.

Similarly, in the case of the head temperature being not lower than 5° C. and lower than 10° C., the first and the second warming resistors are energized for TE seconds (steps S511, S12). The TE second is the time which required by 40° C. of temperature rises of the ink corresponding to the first ejection outlet and about 53° C. of temperature rises of the ink corresponding to the second ejection outlet.

Then, the preliminary ejection is carried out, and the recording operation is started.

Similarly, in the case of the head temperature being not lower than 0° C. and lower than 5° C., the first and second warming resistors are energized for TF seconds (steps S513, S514). The TF second is the time which required by 40° C. of temperature rises of the ink corresponding to the first ejection outlet and about 60° C. of temperature rises of the ink corresponding to the second ejection outlet.

Then, the preliminary ejection is carried out, and the recording operation is started.

By the control as described above, without heating the ink to an unnecessary degree, the temperature of the ink corresponding to the first ejection outlet rises to 40° C., and the temperature of the ink corresponding to the second ejection outlet rises to 50° C. For this reason, even if it is after the non-ejection for about 6 scannings, the ink can be stably ejected at the time of the start of the recording operation.

Figure 20:
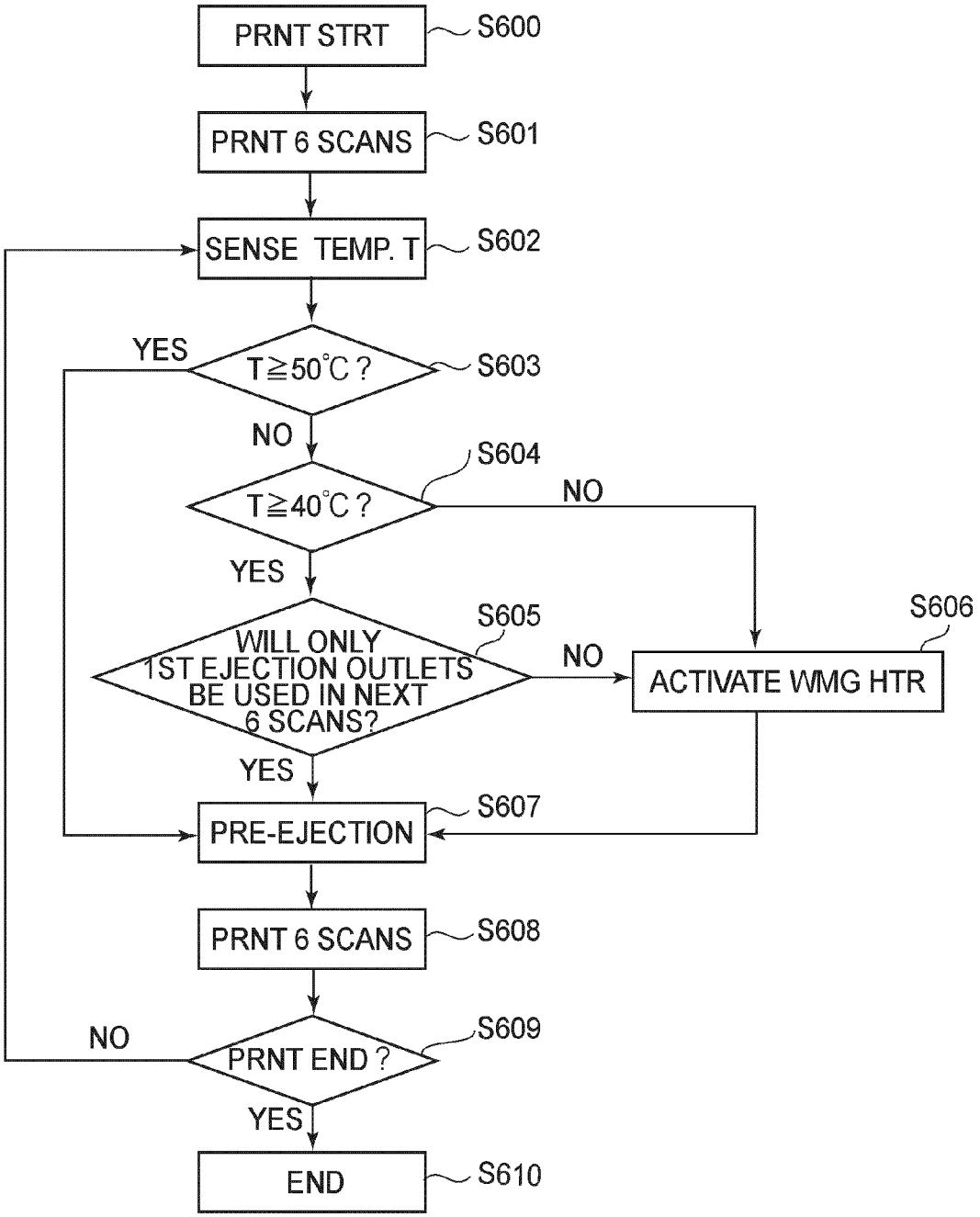
FIG. 20 is a flow-chart diagram of a temperature control process after the record starting operation according to the first embodiment of the present invention.

Then, the operation after the recording start will be described referring to FIG. 20.

As described above, the preliminary ejection is carried out with about 40° C. of the ink ejected from the first ejection outlet, and about 50° C. of the ink ejected from the second ejection outlet, and therefore, the image formation can be stably done during about 6 scannings. For this reason, the recording operation of 6 scannings is carried out after the recording start (steps S600, 601). Thereafter, as shown in a step S602, the head temperature is sensed by the head temperature sensor. In the case where the head temperature is 50° C. higher, the recording operation of the additional 6 scannings is carried out after the preliminary ejection (step S603 and steps S607, 608). At this time, since the head temperature is 50° C. or higher, the ink can be stably ejected during about 6 scannings from the first ejection outlet array and also from the second ejection outlet array. In the case where the head temperature is lower than 50° C. and not lower than 40° C., the operation advances to a step S605, wherein the discrimination is made about whether the ejection outlets which will be used in the next six scannings are only the first ejection outlets. In the case where the ejection outlets which will be used are only the first ejection outlets, the recording operation for the next six scannings is carried out after the preliminary ejection (steps S607, S608). At this time, since the ink corresponding to the first ejection outlet array is about 40° C. which is the temperature with which 6 scanning ejections can be performed sufficiently stably, the image can be formed stably. In the step S605, in the case of the ejection outlets used by the next six scannings not being only the first ejection outlets, in other words, in the case where the second ejection outlet will be used, the warming resistor is energized and the ink corresponding to the ejection outlet is heated. Thereafter, the recording operation of 6 scannings is carried out (steps S607, S608), by which the stabilized images are formed.

When 6 scan recording operations in a step S608 finish, the operation advances to a step S609, wherein the determination is made about whether all the recordings finished. In the case where the recording operation does not finish, the operation returns to the step S602, wherein the head temperature is measured, if so, the operation advances to S610, in which the operation finishes.

In this embodiment, although the case where the temperature sensing is carried out every six scannings has been described, the intervals of the temperature sensing may be changed.

The description will be made about the operation at the time of the suction instructions.

In this embodiment, the first ejection outlet arrays 11A-11C and the second ejection outlet arrays 12*a*-12*c* shown in FIG. 13 are simultaneously covered with a cap, and they are subjected to the suction operation. Between the first ejection outlet array which has the relatively large ejection outlet, and the second ejection outlet array which has the relatively small ejection outlet, the cross-sectional areas of the flow path leading to the ejection outlet differ greatly in addition to the ejection outlet areas. For this reason, when the first ejection outlet arrays and the second ejection outlet arrays are covered by the same cap, and the inks of the same viscosity are suctioned a great amount of ink is suctioned through the first ejection outlet which has a small flow resistance, and a small amount of ink is suctioned through the second ejection outlet which has the large flow resistance, and therefore, the recovery is not sufficient.

In this embodiment, the firsts and the second warming resistors are energized before the suction operation. In this embodiment, the first warming resistor and the second warming resistor are connected with each other in series by the connecting line 104, the resistance ratio between the first warming resistor and the second warming resistor is 2:3, that is, the ratio between the amounts of heat generation is substantially 2:3. For this reason, the temperature rise of the ink relative to the second ejection outlet is larger than the temperature rise of the ink relative to the first ejection outlet, and the viscosity decreases more in the second ejection outlet.

Figure 21:
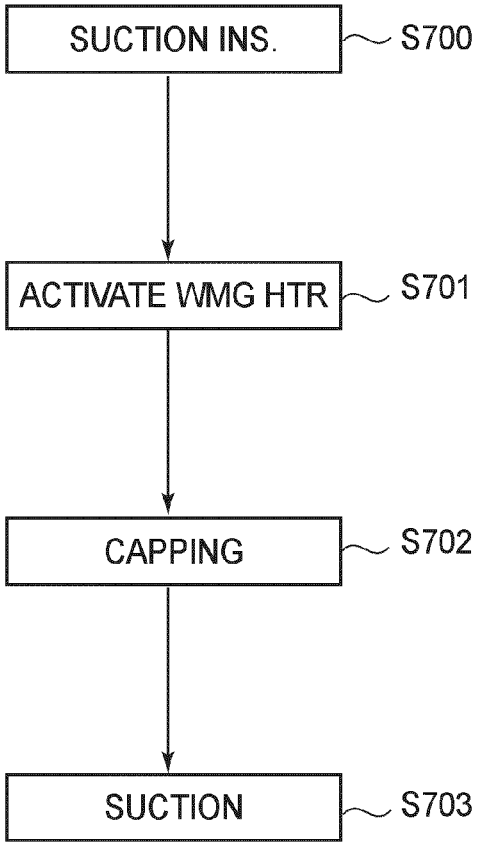
FIG. 21 is a flow-chart diagram which shows a temperature control process at the time of a suction instructions according to the first embodiment of the present invention.

The specific operation will be described referring to FIG. 21. When the suction instructions is produced (step S700), the electrical signal is fed to the heating contact pad 510, 610 (FIG. 5), and the first warming resistor and the second warming resistor are energized simultaneously (step S701). The resistance value of the second warming resistor is larger than that of the first warming resistor, and the amount of heat generation is larger, and therefore, the viscosity of the ink corresponding to the second ejection outlet is lower than the viscosity of the ink corresponding to the first ejection outlet. Thereafter, by carrying out the suction operation, while covering the first ejection outlet array and the second ejection outlet array by the same cap, (steps S702, S703), the ink can be stably suctioned also from the second ejection outlet which has the relatively high flow resistance.

In addition, since it ejects after the ink is heated, the ink is ejected with the high first shot property, so that the frequent preliminary ejection is unnecessary, the amount of a residual ink is reduced, and a throughput is improved. In addition, the ejection is carried out with the high temperature of the ink, and therefore, a complicated pulse control required in order to eject the ink stably at the time of a low temperature and so on is unnecessary.

In this embodiment, although an amount of heat generation ratio between the first warming resistor and the second warming resistor is 2:3, this is not restrictive in the present invention.

In the structure according to the embodiment of the present invention, the first warming resistor and the second warming resistor are constituted by the different material layers, and therefore, the amount of heat generation ratio can further be increased, and a latitude of the amount of heat generation setting with respect to the structure of the ink kind or the ink jet recording head is large. In addition, since the wiring width (range) for the warming resistor which requires the strong heating is large, the heating with the satisfactory efficiency by wider heating is possible.

Fourth Embodiment

In the description of this embodiment, the same reference numerals as in Embodiment 1, 2 and 3 are assigned to the elements having the corresponding functions in this embodiment, and the detailed description thereof is omitted for simplicity.

In this embodiment, the magenta ink has the viscosity higher than the cyan ink and the yellow ink, and the viscosities of the cyan ink and the yellow ink are substantially equal.

Figure 22:
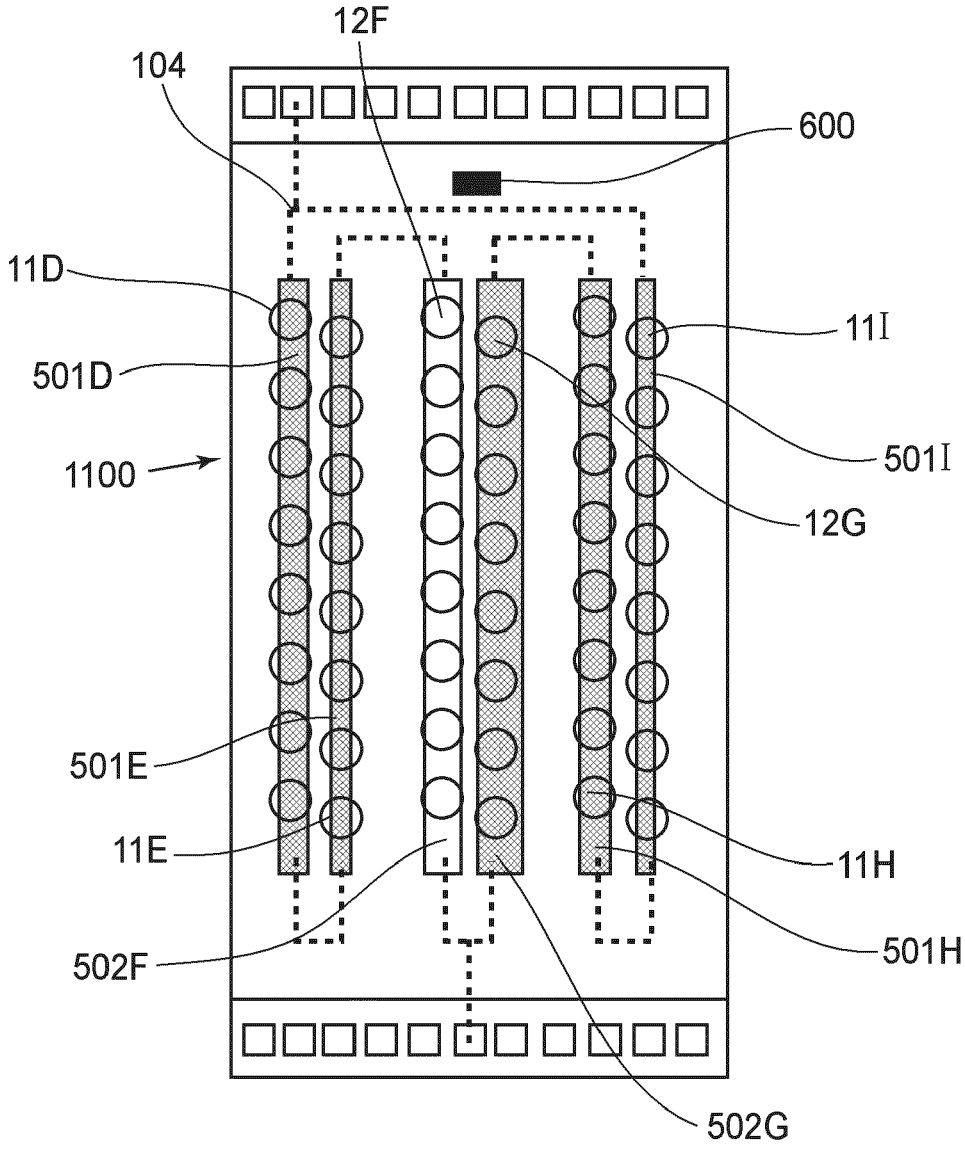
FIG. 22 illustrates a recording element substrate according to the fourth embodiment of the present invention.

FIG. 22 is a top plan view of a recording element substrate according to the present embodiment, wherein a head temperature sensor 600 is provided as in the case of the third embodiment. In addition, the recording element substrate 1100 is provided with an unshown ink supply port. And, the adjacent ejection outlet arrays 11D, 11E are communicated with a supply port for the cyan ink, the adjacent ejection outlet arrays 12F, 12G are communicated with a supply port for the magenta ink, and the adjacent ejection outlet arrays 11H, 11I are communicated with a supply port for the yellow ink. The ejection outlet arrays have the same ejection outlet diameter (16.8 micrometers) and the one drop ejected from the ejection outlet is about 5.7 ng.

In the following descriptions, the ejection outlet arrays 11D, 11E, 11H, 11I for ejecting the cyan ink and the yellow ink having the relatively low viscosity are the first ejection outlet arrays, and the ejection outlet arrays 12F, 12G for ejecting the magenta ink having the relatively high viscosity are the second ejection outlet arrays.

The first warming resistors 501D, 501E, 501H, 501I are provided correspondingly to the first ejection outlet arrays 11D, 11E, 11H, 11I for relatively ejecting the ink of a low viscosity, and the second warming resistors 502F, 502G are provided correspondingly to the second ejection outlet arrays 12F, 12G for ejecting the ink of the relatively high viscosity. The second warming resistor 502 comprising the polysilicon layer has a wiring width of 190 micrometers, and 1.6 micrometers of a connecting line thickness, and the first warming resistor 501 comprising the aluminum layer has a wiring width of 3 micrometers, and 0.8 micrometer of a connecting line thickness. The first warming resistors 501D, 501E, and the first warming resistors 501H and 501I are connected with each other in parallel, and they are connected in series, respectively with the second warming resistor 502F and 502G. The amount of heat generations of the firsts and the second warming resistors by the applied voltage of 24V are approx. 0.5 W and approx. 0.75 W, respectively.

The viscosities of the ink used for the present invention decrease, and the first shot property becomes better, with the rising of the temperature. In the same temperature, the first shot property of the magenta ink having the relatively high viscosity is poorer than the first shot properties of the cyan ink and the yellow ink having the relatively low viscosity.

Figure 23:
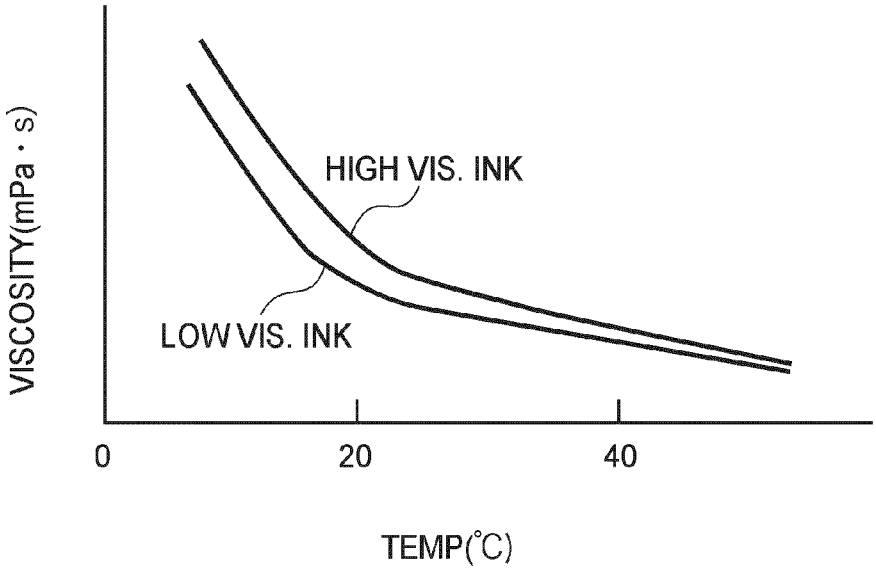
FIG. 23 shows a relation between a head temperature and an ink viscosity.

FIG. 23 shows the relation between the temperature and the viscosity with respect to a low viscous ink and a high viscosity ink. The viscosity lowers and the first shot property also improves with the rising of the temperature. The viscosity is high under the 15° C. ambient condition, so that after the non-ejection of 0.5 or more scanning, the ejection does not stabilize. However, as has been confirmed, when the head is heated to about 40° C., the low viscosity ejected from the first ejection outlet is stably ejected also after the non-ejection of about 6 scannings, also as has been confirmed, when the head is heated to about 50° C., the high viscosity ink ejected from the second ejection outlet is also stably ejected also after the non-ejection of the about 6 scannings.

The operation after the recording instructions is produced is fundamentally the same as the case of the third embodiment (FIG. 18). In addition, the relation between the energization durations of the first and the second warming resistors, and the rising temperature of the ink corresponding to the first warming resistor and the rising temperature of the ink corresponding to the second warming resistor is also as shown in FIG. 19.

As shown in FIG. 18, when the recording instructions is produced (step S500), the current head temperature is sensed by the head temperature sensor 600 (FIG. 22). As a result, as shown in the steps S502, S515, S516, in the case of the head temperature being 50° C. or higher, the ink can be stably ejected also after the non-ejection for about 6 scannings, and therefore, the preliminary ejection is carried out and the recording operation is started.

As indicated by the steps S503, S504, in the case of the head temperature being not lower than 40° C. and lower than 50° C., in order to raise the ink corresponding to the second ejection outlet to 50° C. or more with which it can eject stably also after the non-ejection of the about 6 scannings, the firsts and the second warming resistors are energized for TA second. At this time, the first warming resistor and the second warming resistor are connected in series with each other by the connecting line 104, and the resistance ratio between the first warming resistor and the second warming resistor is 2:3, that is, the amount of heat generation ratio is substantially 2:3. For this reason, as shown in FIG. 19, when the ink corresponding to the second warming resistor is heated so that it rises by about 10° C., the ink corresponding to the first warming resistor also rises by about 7° C.

Then, the preliminary ejection is carried out, the ink corresponding to the first ejection outlet is about 40° C. by the record starting operation, and the ink corresponding to the second ejection outlet is about 50° C., and therefore, the ink can be stably ejected also after about 6 scanning non-ejection.

Similarly, in the case of the head temperature being not lower than 30° C. and lower than 40° C. The firsts and the second warming resistors are energized for the TB second (steps S505, S506). So as to heat the ink corresponding to the first ejection outlet to 40° C. and to heat the ink corresponding to second ejection outlet to 50° C. The TB second is the time taken for the temperature of the ink corresponding to the first ejection outlet to rise by 13° C., and taken for the temperature of the ink corresponding to the second ejection outlet to rise by about 20° C. Then, the preliminary ejection is carried out and the record starting operation is carried out, by which the ink corresponding to the first ejection outlet is about 40° C., and the ink corresponding to the second ejection outlet is about 50° C., and therefore, the ink is stably ejected also after the non-ejection for about 6 scannings.

Similarly, in the case of the head temperature being not lower than 20° C. and lower than 30° C., the firsts and the second warming resistors are energized for TC second (steps S507, S508). The TC second is the time taken for the temperature of the ink corresponding to the first ejection outlet to rise by 20° C., and for the temperature of the ink corresponding to the second ejection outlet to rise by about 30° C. Then, the preliminary ejection is carried out and the recording is started.

Similarly, in the case of the head temperature being not lower than 10° C. and lower than 20° C., the firsts and the second warming resistors are energized for TD second (steps S509, S510). The TD second is the time required for the temperature of the ink corresponding to the first ejection outlet to rise by 30° C., and required for the temperature of the ink corresponding to the second ejection outlet to rise by about 45° C. Then, the preliminary ejection is carried out and the recording operation is started.

Similarly, in the case of the head temperature being not lower than 5° C. and lower than 10° C., the firsts and second warming resistors are energized for TE second (steps S511, S512). The TE second is the time taken for the temperature of the ink corresponding to the first ejection outlet to rise by 40° C., and for the temperature of the ink corresponding to the second ejection outlet to rise by about 53° C. Then, the preliminary ejection is carried out, and the recording operation is started.

Similarly, in the case of the head temperatures' being not lower than 0° C. lower than 5° C., the firsts and second warming resistors are energized for TF second (steps S513, S514). The TF second is the time taken for the temperature of the ink corresponding to the first ejection outlet to rise by 40° C., and for the temperature of the ink corresponding to the second ejection outlet to rise by about 60° C. Then, the preliminary ejection is carried out, and the recording operation is started.

By the control as described above, since the ink corresponding to the first ejection outlet is 40° C. or more and the ink corresponding to the second ejection outlet is 50° C. or more, without heating the ink unnecessarily, the ink can be stably ejected also after the non-ejection for about 6 scannings at the time of the recording start.

The description will be made about the operation after the recording start, referring to FIG. 20.

As described above, the ink ejected from the first ejection outlet is about 40° C., the ink ejected from the second ejection outlet is about 50° C., and the preliminary ejection is carried out in this state, and therefore, the stable image formation can be performed for about 6 scannings. For this reason, the recording operation of 6 scannings is carried out after the recording start (steps S600, S601). Thereafter, the operation advances to the step S602, in which the head temperature sensor senses the head temperature. In the case where the head temperature is 50° C. or more, the preliminary ejection is carried out, and the recording operation of the additional 6 scannings is carried out (step S603 and steps S607, S608). At this time, since the head temperature is 50° C. or more, the ejections for about 6 scannings can carry out stably from the first ejection outlet array and the second ejection outlet array. In the case where the head temperature is lower than 50° C. and not lower than 40° C., the operation advances to the step S605, in which the discrimination is made about whether the ejection outlets which will be used in the next six scannings are only the first ejection outlets, if so, the preliminary ejection is carried out and the recording operation of the next six scannings is carried out (steps S607, S608). At this time, since the ink corresponding to the first ejection outlet array has reaches 40° C. which is the temperature which can perform the ejection sufficiently stably for 6 scannings, so that the images can be formed stably, if not, that is, in the case where the second ejection outlet is used, the warming resistor is energized, and the ink corresponding to the ejection outlet is heated. Thereafter, the recording operation for 6 scannings is carried out (steps S607, S608), so that the stabilized images are formed.

When 6 scanning recordings in the step S608 finish, the discrimination is made about whether all the recordings finished in the step S609, if not, the operation returns to the step S602, in which the head temperature is sensed, if so, the operation advances to S610, in which the ejecting operation finishes.

In this embodiment, although the case where the temperature sensing is carried out every six scannings has been described, the intervals of the temperature sensing may be changed.

The description will be made about the operation at the time of suction instructions. Also in this embodiment, the first ejection outlet arrays 11D, 11E, 11H, 11I and the second ejection outlet arrays 12F, 12G which are shown in FIG. 22 are simultaneously covered by the cap, and the suction operation is carried out. The first ejection outlet array corresponding to the ink having the relatively low viscosity and the second ejection outlet array corresponding to the ink having the relatively high viscosity are covered by the same cap, and the suction is carried out, then the great amount of ink is suctioned from the first ejection outlets corresponding to the cyan and the yellow inks having the relatively low viscosity.

As a result, a small amount of ink is suctioned from the second ejection outlet corresponding to the magenta ink having the relatively high viscosity, and therefore, sufficient recovery may be unable to be performed.

In view of this, in this embodiment, the firsts and the second warming resistors are energized before the suction. In this embodiment, the first warming resistor and the second warming resistor are connected in series with each other by the connecting line 104, a resistance ratio between the first warming resistor and the second warming resistor is 2:3, that is, the amounts of heat generation ratio is substantially 2:3. For this reason, the temperature rise of the ink relative to the second ejection outlet is higher, and the viscosity is sufficiently lower than the temperature rise of the ink relative to the first ejection outlet.

Specifically, the operation will be described, referring to FIG. 21. When the suction instructions is produced (step S700), the electric signal is fed to the warming contact pad 510, 610 (FIG. 5), and the first warming resistor and the second warming resistor are energized simultaneously (step S701). The resistance value of the first warming resistor is smaller than the resistance value of the second warming resistor, and the amount of heat generation thereof is larger, and therefore, the temperature of the ink corresponding to the second ejection outlet is higher than the temperature of the ink corresponding to the first ejection outlet. As a result, the viscosity of the magenta ink which exhibits the relatively high viscosity in the same temperature lowers, so that it becomes the viscosity comparable to those of the cyan and yellow inks. Thereafter, the first ejection outlet array and the second ejection outlet array are covered by the same cap (step S702), and the suction operation is carried out (step S703), so that the ink is stably suctioned also from the second ejection outlet.

Similarly to the third embodiment, the ink is heated to carry out the ejection, and the ink is ejected with the high first shot property, and therefore, the frequent preliminary ejection is unnecessary, and the reduction of the amount of residual inks and the improvement in the throughput are accomplished. In addition, the ejection is carried out with the high temperature of the ink, and therefore, the complicated pulse control for stably ejecting the ink at the time of the low temperature and so on is unnecessary.

In this embodiment, although the firsts and the second warming resistors are constituted by the aluminum layer and the polysilicon layer which are used for the logic circuit, the third warming resistor may be constituted by forming the new layer on the recording element substrate. For example, an aluminum layer, a polysilicon layer, or another layer having the different thickness is provided interposing an interlayer insulation film, so that the present invention can be used also in the case where the cyan, magentas and yellow inks have the different properties.

Fifth Embodiment

In the description of this embodiment, the same reference numerals as in Embodiments 1-4 are assigned to the elements having the corresponding functions in this embodiment, and the detailed description thereof is omitted for simplicity.

Figure 24:
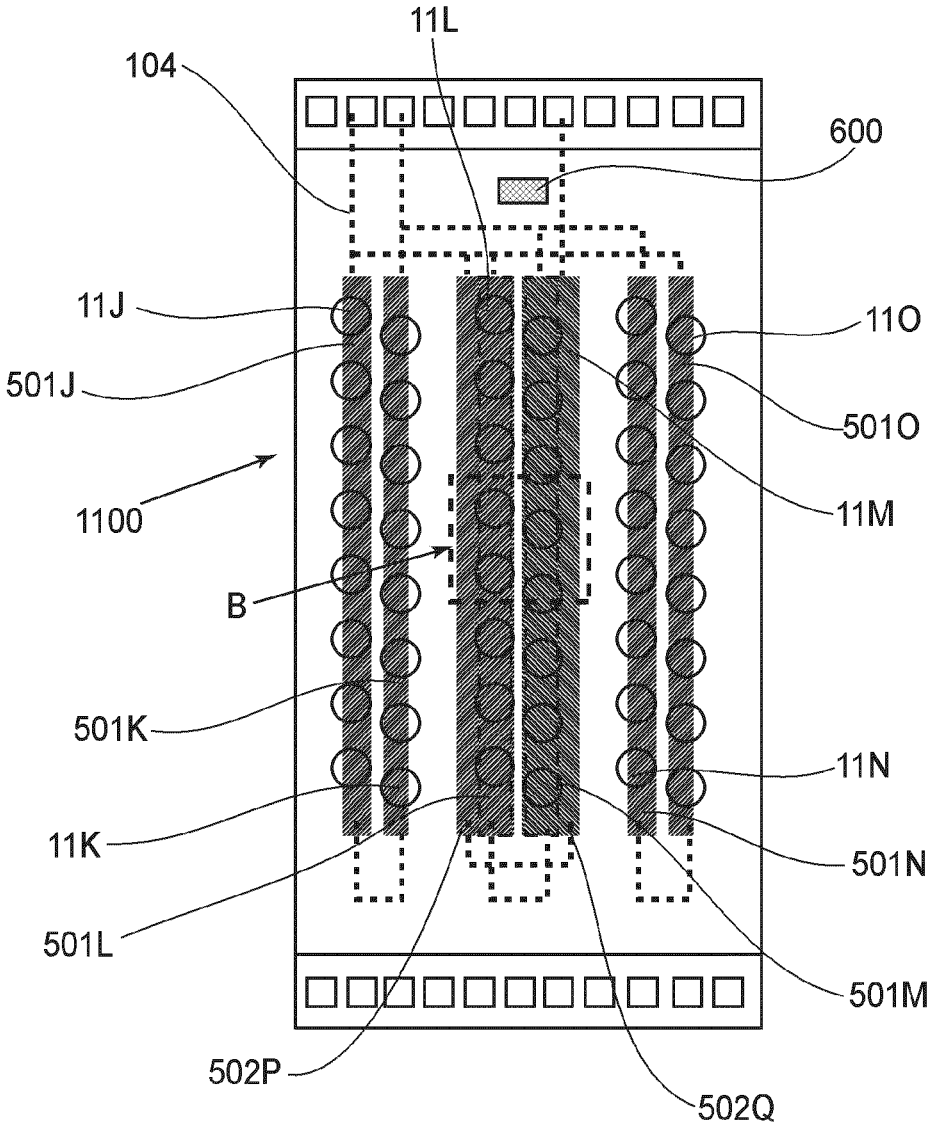
FIG. 24 illustrates a recording element substrate of a fifth embodiment according to the present invention.

FIG. 24 is a top plan view of a recording element substrate in the present embodiment, wherein a temperature sensor 600 is provided as in the third embodiment. In addition, the recording element substrate 1100 is provided with unshown ink supply ports, and the adjacent ejection outlet arrays 11J, 11K are communicated with a supply port for the cyan ink, and the adjacent ejection outlet arrays 11L, 11M are communicated with a supply port for the magenta ink, and the adjacent ejection outlet arrays 11N, 11O are communicated with a supply port for the yellow ink. The ejection outlet arrays have the same ejection outlet diameter of 16.8 micrometer, and the one drop ejected from the ejection outlet of an ejection amount of the ink is about 5.7 ng. The first warming resistors 501J, 501K, 501L, 501M, 501N, 501O are provided, respectively correspondingly to the ejection outlet arrays 11J, 11K, 11L, 11M, 11N, 11O. These comprise the aluminum layer and have a wiring width m of 1.5 micro, and 0.4 micro of a connecting line thickness m.

In addition, the ejection outlet arrays 11L, 11M are provided with second warming resistors 502P, 502Q, respectively. These comprise the polysilicon layer and have a wiring width of 150 micrometers, and 0.78 micrometer of a connecting line thickness.

Figure 5:
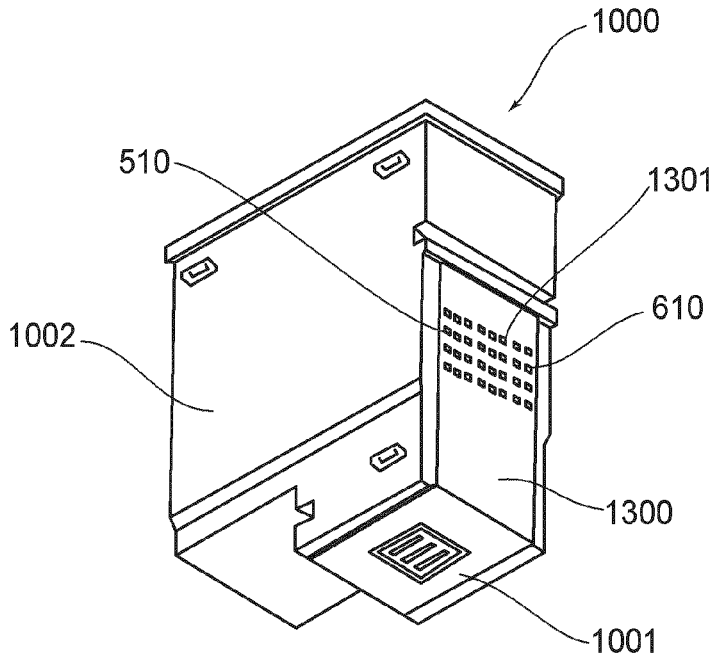
FIG. 5 is a perspective view of an ink jet cartridge according to the first embodiment of the present invention.

In this embodiment, pairs 501J, 501K, 501L, 501M, 501N, and 501O of the first warming resistor are connected with each other in series, respectively, and they are electrically connected with the first warming contact pad 510 shown in FIG. 5. The amount of heat generation of the warming resistor at the time of the voltage application of 24V is about 0.5 W. Additionally, the second warming resistors 502P, 502Q are connected with each other in series by the connecting line 104, and they are electrically connected with the second warming contact pad 610 shown in FIG. 5. The amount of heat generation of the warming resistor at the time of the voltage application of 24V is about 0.75 W.

Figure 25A:
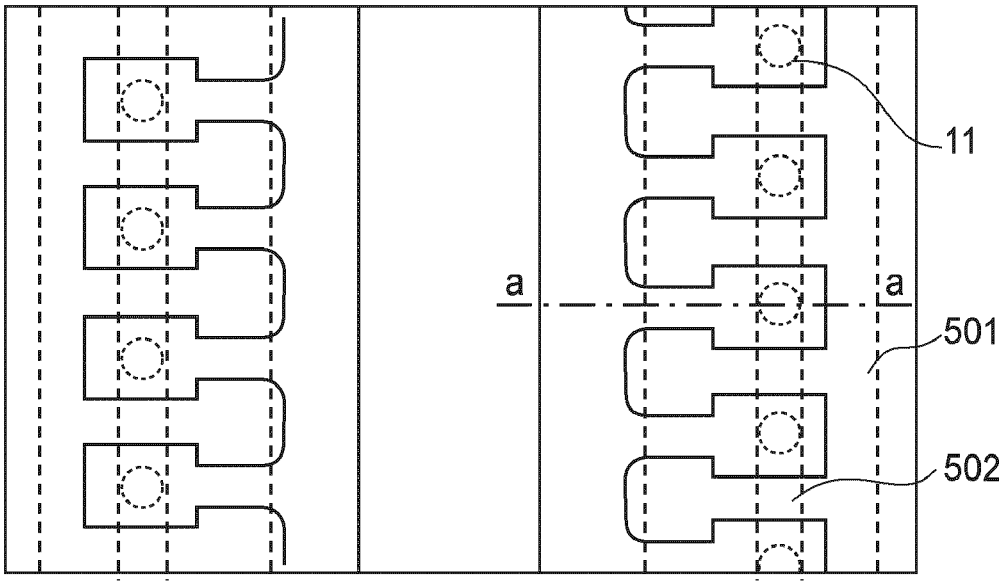
FIG. 25A is an enlarged view of a B portion of FIG. 24.
Figure 25B:
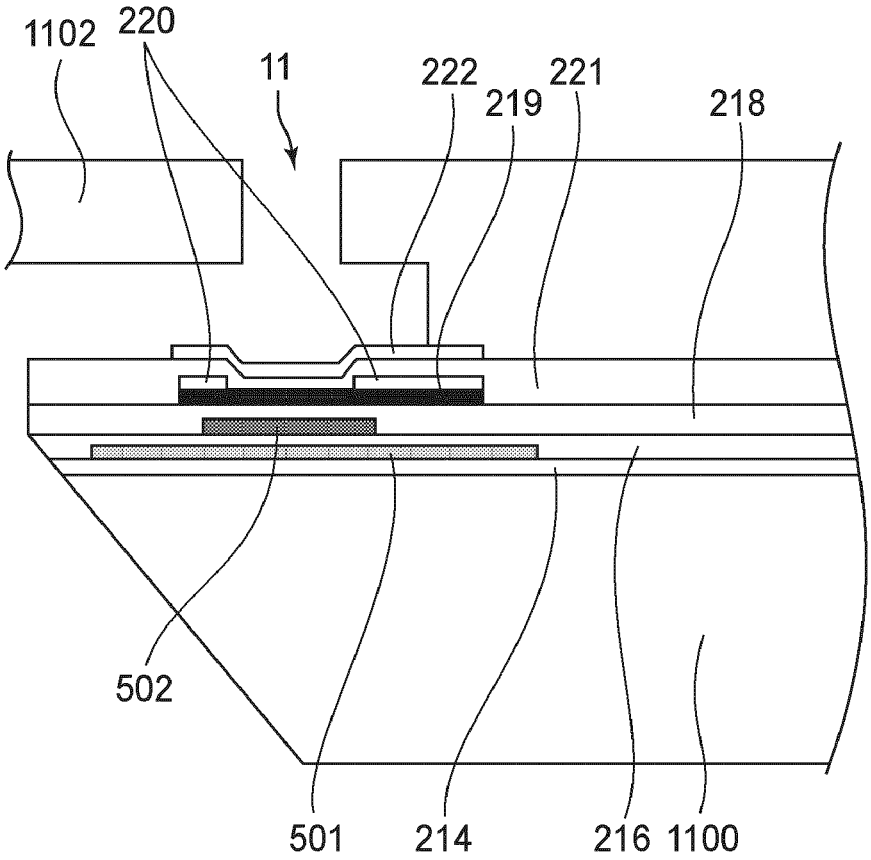
FIG. 25B is an a-a sectional view of FIG. 25A.

FIG. 25 illustrates the position of the warming resistor, wherein FIG. 25A is an enlarged view of B portion of FIG. 24, and FIG. 24B is an a-a section of the FIG. 24A. As shown in FIG. 24, parts of the first warming resistors 502 and the second warming resistors 501 are disposed below an ink flow path portion communicated with the ejection outlet in order to supply the ink to the ejection outlet.

In the case that, the viscosities of the magenta ink, the cyan ink, and the yellow ink are almost the same, and the temperature dependences of the viscosity or the first shot property are also substantially the same, the stable ink ejection is accomplished by energizing the contact pad 610 in response to the head temperature. However, when the viscosity of the magenta ink is higher than those of the cyan ink and the yellow ink, the ejection of the stable ink is accomplished by energizing through the contact pad 510 in addition to the contact pad 610. In this manner, in the present embodiment, even if the magenta ink used for the ink jet recording head is changed, the heating of the ink corresponding to the property thereof can be carried out efficiently.

In this embodiment, although both of the first warming resistor and the second warming resistor are provided only in the ejection outlet array of the magenta ink, both warming resistors may be provided for each ejection outlet array. In this case, all the first warming resistors are connected by a common wiring line, and the second warming resistor wires independently from each other for the ejection outlet arrays corresponding to the respective inks. By doing so, in the case where the property of the inks is uniform substantially, they can be heated substantially uniformly by the first warming resistor, and in the case where the specific ink has a different property, only the ink thereof can selectively strongly be heated, and therefore, the efficient heating is accomplished.

In addition, the second warming resistors are wired independently for the respective ejection outlet arrays, by which even if there is a difference in the ejection outlet diameter between the ejection outlet arrays, the heating control can be performed efficiently.

In addition, in the present embodiment, although the first and second warming resistors are constituted by the aluminum layer and the polysilicon layer which are used for the logic circuit, the third warming resistor may be constituted by forming a new layer on the recording element substrate. For example, the aluminum layer, the polysilicon layer, or the other layer having a different thickness is additionally provided interposing the interlayer insulation film, by which a various combination can be coped with.

As described in detail in the foregoing, according to these embodiments, the first warming resistor is disposed in the lower layer of the ejecting resistor, and it is disposed below the ink flow path portion, and therefore, the suitable position is heated efficiently. By this, a driving energy of the heat generating resistor for the discharging can be reduced and ejection efficiency is improved. In addition, upsizing beyond the necessity for the recording element substrate and the increase of the manufacturing cost can be suppressed.

Furthermore, by controlling the amount of heat generation thereof in response to the head temperature using the first warming resistor and the second warming resistor, the production of the temperature difference between the end and the central portion of the recording element substrate can be efficiently suppressed during the recording. By this, the ink jet recording head without the remarkable reduction of the image quality is provided.

In addition, a heating degree can be easily set properly depending on the position on the recording element substrate, and therefore, since it can heat efficiently, without raising the temperature of the head more than needed, stable ejection control is accomplished.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 161592/2007 filed Jun. 19, 2007, which is hereby incorporated by reference herein.

What is claimed is:

1. An ink jet recording head comprising:

an ejection outlet array including a plurality of ejection outlets;

an ink flow path portion in fluid communication with said ejection outlets to supply ink to said ejection outlets;

a recording element substrate provided with said ejection outlet array, said ink flow path portion and a plurality of ejection heat generating resistors, provided correspondingly to said ejection outlets, for generating thermal energy for ejecting ink;

a first warming heat generating resistor which is provided in lower layers of said ejecting heat generating resistors and which is extended below said ink flow path portion; and a second warming heat generating resistor provided in an outer peripheral portion of said recording element substrate.

2. An ink jet recording head according to claim 1, wherein amounts of heat generation of said first warming heat generating resistor and said second warming heat generating resistor are controlled in accordance with a temperature of said recording element substrate.

3. An ink jet recording head according to claim 1, wherein said first warming heat generating resistor is energized to generate heat before start of a recording operation.

4. An ink jet recording head according to claim 1, wherein said second warming heat generating resistor is energized to generate heat during the recording operation.

5. An ink jet recording head according to claim 1, wherein during the recording operation, amounts of heat generation of said first warming heat generating resistor and said second warming heat generating resistor are controlled in accordance with a temperature of said recording element substrate.

6. An ink jet recording head according to claim 1, wherein an amount of heat generation of said first warming heat generating resistor is larger than that of said second warming heat generating resistor.

7. An ink jet recording head comprising:

a plurality of ejection outlet arrays each comprising a plurality of ejection outlets;

an ink flow path portion in fluid communication with said ejection outlets to supply ink to said ejection outlets;

a plurality of ink supply ports for supplying ink to said ink flow path portion for said ejection outlet arrays;

a recording element substrate provided with said ejection outlet arrays, said ink flow path portion and a plurality of ejection heat generating resistors, provided correspondingly to said ejection outlets, for generating thermal energy for ejecting ink;

a plurality of warming heat generating resistors which are provided in lower layers of said ejecting heat generating resistors and which are extended below said ink flow path portion for said ejection outlet arrays.

8. An ink jet recording head according to claim 7, wherein at least two of said warming heat generating resistor comprise layers of different materials.

9. An ink jet recording head according to claim 7, wherein said ejection outlet arrays include a first ejection outlet array of ejection outlets having a relatively large ejection outlet diameter and a second ejection outlet array of ejection outlets having a relatively small ejection outlet diameter, and wherein said warming heat generating resistor for said first ejection outlet array comprises a material layer, and said warming heat generating resistor for said second ejection outlet array comprises a material layer different from the material layer for said first ejection outlet array.

10. An ink jet recording head according to claim 9, wherein a width occupied by said warming heat generating resistor for said first ejection outlet array is larger than a width occupied by said warming heat generating resistor for said second ejection outlet array.

11. An ink jet recording head according to claim 10, wherein a plurality of said warming heat generating resistors are provided corresponding to at least one of said ejection outlet arrays.

12. An ink jet recording head according to claim 7, wherein said ink supply ports include a first ink supply port for supplying ink having a relatively low viscosity and a second ink supply port for supplying ink having a relatively high viscosity, and wherein said warming heat generating resistor for said ejection outlet array in fluid communication with said first ink supply port and said warming heat generating resistor for said ejection outlet array in fluid communication with said second ink supply port are made of materials different from each other.

13. An ink jet recording head according to claim 12, wherein a width occupied by said warming heat generating resistor corresponding to said first ink supply port is larger than a width occupied by said warming heat generating resistor corresponding to said second ink supply port.

* * * * *